US010731239B2

(12) United States Patent
Thomas et al.

(10) Patent No.: US 10,731,239 B2
(45) **Date of Patent: *Aug. 4, 2020**

(54) HIGH-STRENGTH ALPHA-BETA TITANIUM ALLOY

(71) Applicant: Titanium Metals Corporation, Henderson, NV (US)

(72) Inventors: Roger Owen Thomas, Swansea South Wales (GB); Paul Garratt, Swansea South Wales (GB); Matthew Thomas, Swansea South Wales (GB); Yoji Kosaka, Henderson, NV (US)

(73) Assignee: TITANIUM METALS CORPORATION, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/053,098

(22) Filed: Aug. 2, 2018

(65) Prior Publication Data

US 2018/0340248 A1 Nov. 29, 2018

Related U.S. Application Data

(62) Division of application No. 14/179,946, filed on Feb. 13, 2014, now Pat. No. 10,066,282.

(51) Int. Cl.

| | |
|---|---|
| ***C22F 1/18*** | (2006.01) |
| ***C22C 14/00*** | (2006.01) |
| ***B21J 5/00*** | (2006.01) |
| ***B22D 7/00*** | (2006.01) |
| ***B22D 21/00*** | (2006.01) |
| ***C21D 1/26*** | (2006.01) |
| ***C22C 1/02*** | (2006.01) |

(52) U.S. Cl.

CPC ..... *C22F 1/183* (2013.01); *B21J 5/002* (2013.01); *B22D 7/005* (2013.01); *B22D 21/005* (2013.01); *C21D 1/26* (2013.01); *C22C 1/02* (2013.01); *C22C 14/00* (2013.01)

(58) Field of Classification Search

CPC ..... C22F 1/183

See application file for complete search history.

(56) References Cited

FOREIGN PATENT DOCUMENTS

| | | |
|---|---|---|
| EP | 2644724 | 10/2013 |
| JP | H05279773 | 10/1993 |
| JP | 2013023697 | 2/2013 |
| RU | 2082803 | 6/1997 |
| RU | 2436858 | 12/2011 |
| WO | 2012012102 | 1/2012 |

OTHER PUBLICATIONS

European Search Report for European Application 19159416, dated Apr. 5, 2019.

*Primary Examiner* — Christopher S Kessler

(74) *Attorney, Agent, or Firm* — Burris Law, PLLC

(57) ABSTRACT

A method of making an alpha-beta titanium alloy is provided. The method includes forming a melt and solidifying the melt to form an ingot. The melt composition includes concentrations of Al from about 4.7 wt. % to about 6.0 wt. %; V from about 6.5 wt. % to about 8.0 wt. %; Si at less than 1 wt. %; Fe at up to about 0.3 wt. %; 0 at less than 1 wt. %; and a balance of Ti and incidental impurities. Furthermore, the Al/V ratio in the melt is equal to the concentration of the Al divided by the concentration of the V in weight percent is from about 0.65 to about 0.8.

18 Claims, 12 Drawing Sheets

10 μm

10 μm

HIGH-STRENGTH ALPHA-BETA TITANIUM ALLOY

CROSS-REFERENCE TO RELATED APPLICATIONS

This application is a divisional application of U.S. application Ser. No. 14/179,946 filed on Feb. 13, 2014, which is incorporated herein by reference.

FIELD

The present disclosure is related generally to titanium alloys and more particularly to alpha-beta titanium alloys having high specific strength.

BACKGROUND

The statements in this section merely provide background information related to the present disclosure and may not constitute prior art.

Titanium alloys have been used for aerospace and non-aerospace applications for years due to their high strength, light weight and excellent corrosion resistance. In aerospace applications, the achievement of high specific strength (strength/density) is critically important, and thus weight reduction is a primary consideration in component design and material selection. The application of titanium alloys in jet engine applications ranges from compressor discs and blades, fan discs and blades and casings. Common requirements in these applications include excellent specific strength, superior fatigue properties and elevated temperature capabilities. In addition to properties, producibility in melting and mill processing and consistent properties throughout parts are also important.

Titanium alloys may be classified according to their phase structure as alpha (α) alloys, alpha-beta (α/β) alloys or beta (β) alloys. The alpha phase is a close-packed hexagonal phase and the beta phase is a body-centered cubic phase. In pure titanium, the phase transformation from the alpha phase to the beta phase occurs at 882° C.; however, alloying additions to titanium can alter the transformation temperature and generate a two-phase field in which both alpha and beta phases are present. Alloying elements that raise the transformation temperature and have extensive solubility in the alpha phase are referred to as alpha stabilizers, and alloying elements that depress the transformation temperature, readily dissolve in and strengthen the beta phase and exhibit low alpha phase solubility are known as beta stabilizers.

Alpha alloys contain neutral alloying elements (such as tin) and/or alpha stabilizers (such as aluminum and/or oxygen). Alpha-beta alloys typically include a combination of alpha and beta stabilizers (such as aluminum and vanadium in Ti-6Al-4V) and can be heat-treated to increase their strength to various degrees. Metastable beta alloys contain sufficient beta stabilizers (such as molybdenum and/or vanadium) to completely retain the beta phase upon quenching, and can be solution treated and aged to achieve significant increases in strength in thick sections.

Alpha-beta titanium alloys are often the alloys of choice for aerospace applications due to their excellent combination of strength, ductility and fatigue properties. Ti-6Al-4V, also known as Ti-64, is an alpha-beta titanium alloy and is also the most commonly used titanium alloy for airframe and jet engine applications. Higher strength alloys such as Ti-550 (Ti-4Al-2Sn-4Mo-0.5Si), Ti-6246 (Ti-6Al-2Sn-4Zr-6Mo) and Ti-17 (Ti-5Al-2Sn-2Zr-4Mo-4Cr) have also been developed and are used when higher strength than achievable with Ti-64 is required.

Table 1 summarizes the high strength titanium alloys currently used in aerospace applications, including jet engines and airframes, at low to intermediate temperatures, where the densities of the alloys are compared. Ti-64 is used as the baseline material due to its wide usage for aerospace components. As can be seen from the data in Table 1, most of the high strength alloys, including alpha-beta and beta alloys, attain increased strength due to the incorporation of larger concentrations of Mo, Zr and/or Sn, which in turn leads to cost and weight increases in comparison with Ti-64. The high strength commercial alloys Ti-550 (Ti-4Al-2Sn-4Mo-0.5Si), Ti-6246 (Ti-6Al-2Sn-4Zr-6Mo) and Ti-17 (Ti-5Al-2Sn-2Zr-4Mo-4Cr), which are used for jet engine discs, contain heavy alloying elements such as Mo, Sn and Zr, except for Ti-550 that does not contain Zr. A typical density of high strength commercial alloys is 4-5% higher than the baseline Ti-64 alloy. A weight increase tends to have a more negative impact on rotating components than on static components.

TABLE 1

Characteristics of various titanium alloys

| Category | Alloy | Composition | Density g/cm³ | Density lb/in³ | Density increase % | Remarks |
|---|---|---|---|---|---|---|
| α/β Alloy | Ti-64 | Ti—6Al—4V | 4.43 | 1.60 | 0.0% | Comparison-Baseline |
| | Ti-575 | Ti—5.3Al—7.5V—0.5Si | 4.50 | 1.63 | 1.6% | Inventive Example |
| | Ti-6246 | Ti—6Al—2Sn—4Zr—6Mo | 4.65 | 1.68 | 5.0% | Comparison |
| | Ti-17 | Ti—5Al—2Sn—2Zr—4Mo—4Cr | 4.65 | 1.68 | 5.0% | Comparison |
| | Ti-550 | Ti—4Al—2Sn—4Mo—0.5Si | 4.60 | 1.66 | 3.8% | Comparison |
| | Ti-662 | Ti—6Al—6V—2Sn | 4.54 | 1.64 | 2.5% | Comparison |
| | Ti-62222 | Ti—6Al—2Sn—2Zr—2Mo—2Cr—0.2Si | 4.65 | 1.68 | 5.0% | Comparison |
| β Alloy | Beta C | Ti—3Al—8V—6Cr—4Mo—4Zr | 4.82 | 1.74 | 8.8% | Comparison |
| | Ti-10-23 | Ti—10V—2Fe—3Al | 4.65 | 1.68 | 5.0% | Comparison |
| | Ti-18 | Ti—5V—5Mo—5.5Al—2.3Cr—0.8Fe | 4.65 | 1.68 | 5.0% | Comparison |

SUMMARY

An alpha-beta titanium alloy (which may be referred to as Timetal® 575 or Ti-575 in the present disclosure) that may exhibit a yield strength at least 15% higher than that of Ti-6Al-4V under equivalent solution treatment and aging conditions is described herein. The alpha-beta titanium alloy may also exhibit a maximum stress that is at least 10% higher than that of Ti-6Al-4V for a given number of cycles in low cycle fatigue and notch low cycle fatigue tests. Furthermore, the titanium alloy, when appropriately processed, may exhibit simultaneously both higher strength and a similar ductility and fracture toughness in comparison to a reference Ti-6Al-4V alloy. This may ensure adequate damage tolerance to enable the additional strength to be exploited in component design.

In one form of the present disclosure, a method of making a high-strength alpha-beta titanium alloy is provided. The method comprises forming a melt and solidifying the melt to form an ingot. The melt comprises: Al at a concentration from about 4.7 wt. % to about 6.0 wt. %; V at a concentration from about 6.5 wt. % to about 8.0 wt. %; Si at a concentration of less than 1 wt. %; Fe at a concentration of up to about 0.3 wt. %; O at a concentration of less than 1 wt. %; with Ti and incidental impurities as a balance. Further, an Al/V ratio in the melt equal to the concentration of the Al divided by the concentration of the V in weight percent is from about 0.65 to about 0.8, and the Al/V ratio from about 0.65 to about 0.8 results in a specific yield strength of the ingot of at least 220 kN·m/kg at room temperature and a fracture toughness of the ingot of at least 40 $MPa \cdot m^{1/2}$ at room temperature.

In some aspects of the present disclosure, forming the melt comprises one or more of vacuum arc remelting, electron beam cold hearth melting, and plasma cold hearth melting. Also, methods disclosed herein may include thermomechanically processing the ingot to form a workpiece and heat treating the work piece. The thermomechanical processing may comprise one or more of open die forging, closed die forging, rotary forging, hot rolling, and hot extrusion. Also, the heat treating may comprise one or more of solution treating, beta annealing, and aging. In one aspect of the present disclosure, the heat treating comprises solution treating the workpiece at a first temperature from about 150° C. to about 25° C. below beta transus; cooling the workpiece to ambient temperature; and aging the workpiece at a second temperature lower than the first temperature. In some aspects of the present disclosure, the second temperature may be in the range from about 400° C. to about 625° C.

The melt may further comprise at least one additional alloying element of less than 1.5 wt. % Sn, less than 0.6 wt. % Mo, and less than 1.5 wt. % Zr. In some aspects of the present disclosure, the melt may comprise Si from about 0.15 wt. % to about 0.6 wt. % and O from about 0.15 wt. % to about 0.23 wt. %. In at least one aspect of the present disclosure, the melt comprises: Al at a concentration from about 5.0 to about 5.6 wt. %; V at a concentration from about 7.2 wt. % to about 8.0 wt. %; Si at a concentration from about 0.2 wt. % to about 0.5 wt. %; C at a concentration from about 0.02 wt. % to about 0.08 wt. %; and O at a concentration from about 0.17 wt. % to about 0.22 wt. %. Also, each of the incidental impurities in the melt may have a concentration of 0.1 wt. % or less and/or the incidental impurities in the melt together may have a concentration of 0.5 wt. % or less. In some aspects of the present disclosure, precipitates of an alpha phase may be dispersed within a beta phase.

In at least one aspect of the present disclosure the ingot comprises a yield strength of at least 970 MPa and an elongation of at least 10% at room temperature. In some aspects of the present disclosure, the ingot has a low cycle fatigue (LCF) maximum stress of at least one of about 925 MPa over about 65,000 cycles and between about 950 MPa over about 68,000 and 1,010 MPa over about 46,000 cycles. Also, the ingot may have a density less than 4.57 $g/cm^3$ and the methods of the present disclosure may be used to form parts.

The terms "comprising," "including," and "having" are used interchangeably throughout this disclosure as open-ended terms to refer to the recited elements (or steps) without excluding unrecited elements (or steps).

DRAWINGS

Figure 3A:
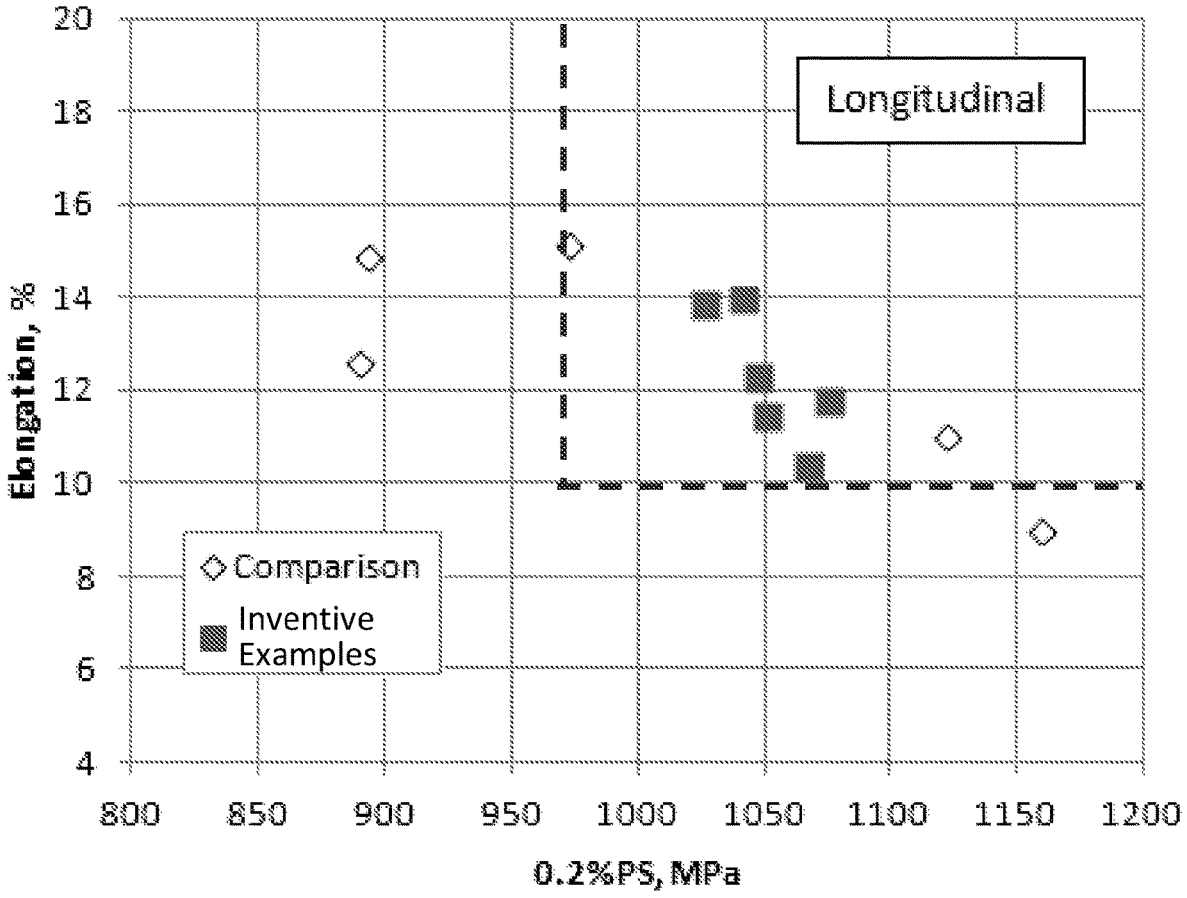
Figure 3B:
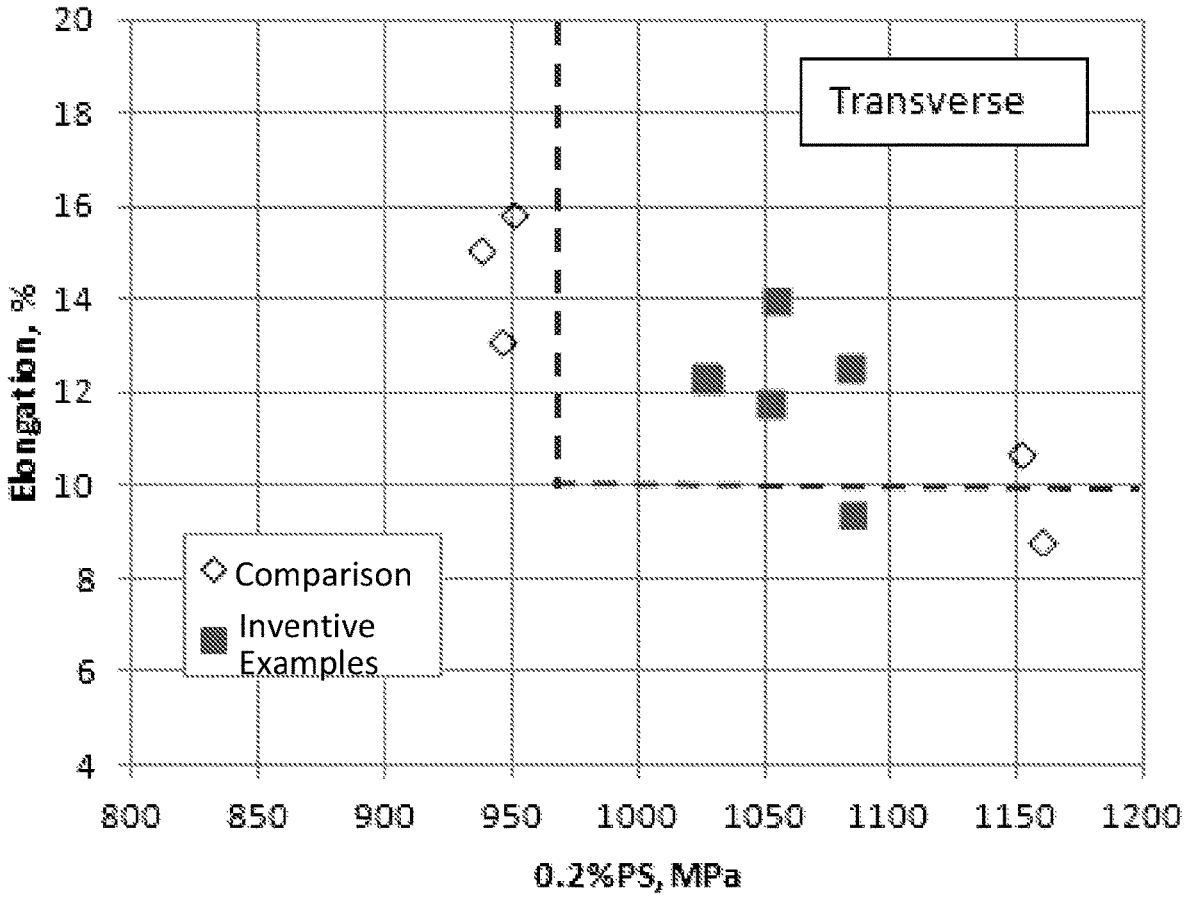

FIGS. 3A and 3B graphically show the results of tensile tests using data provided in Table 5 for the longitudinal and transverse directions, respectively.

Figure 3C:
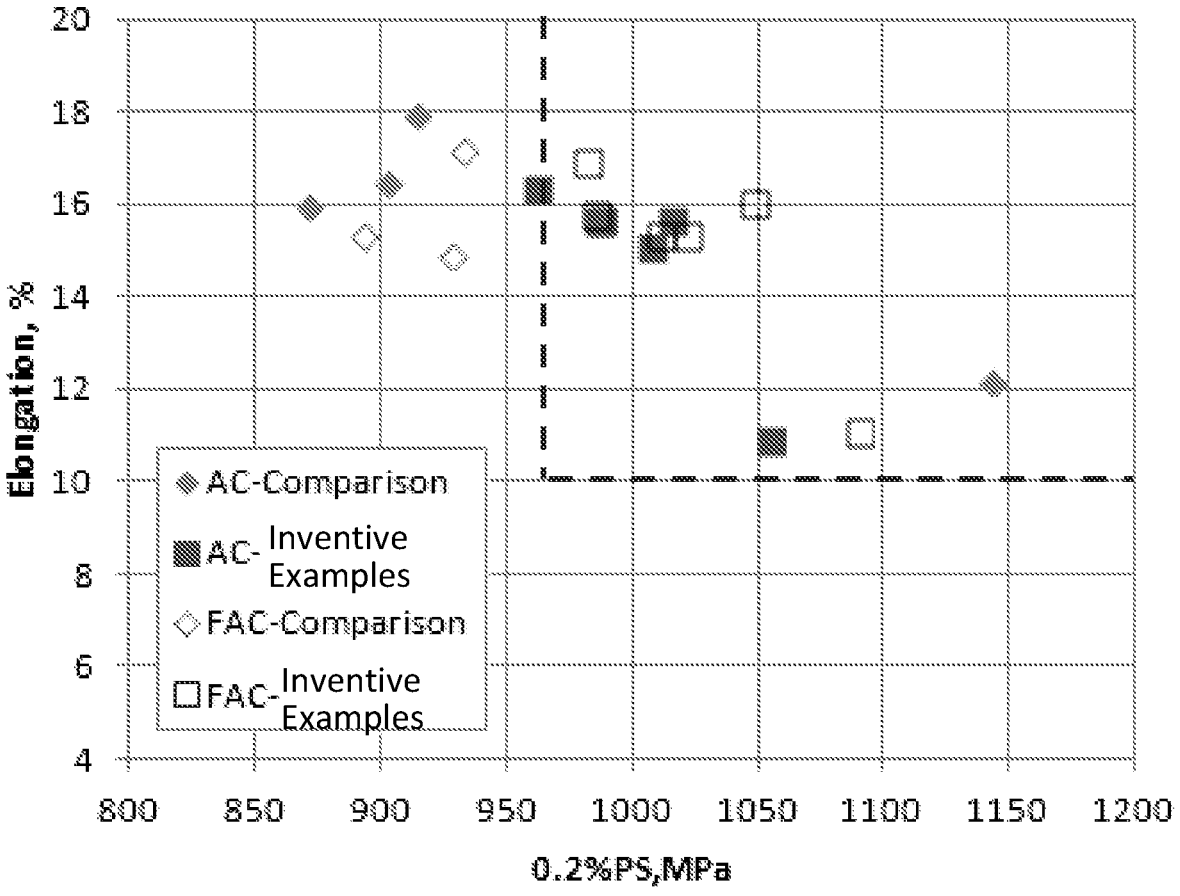

FIG. 3C graphically shows the results of tensile tests using data provided in Table 6.

Figure 4:
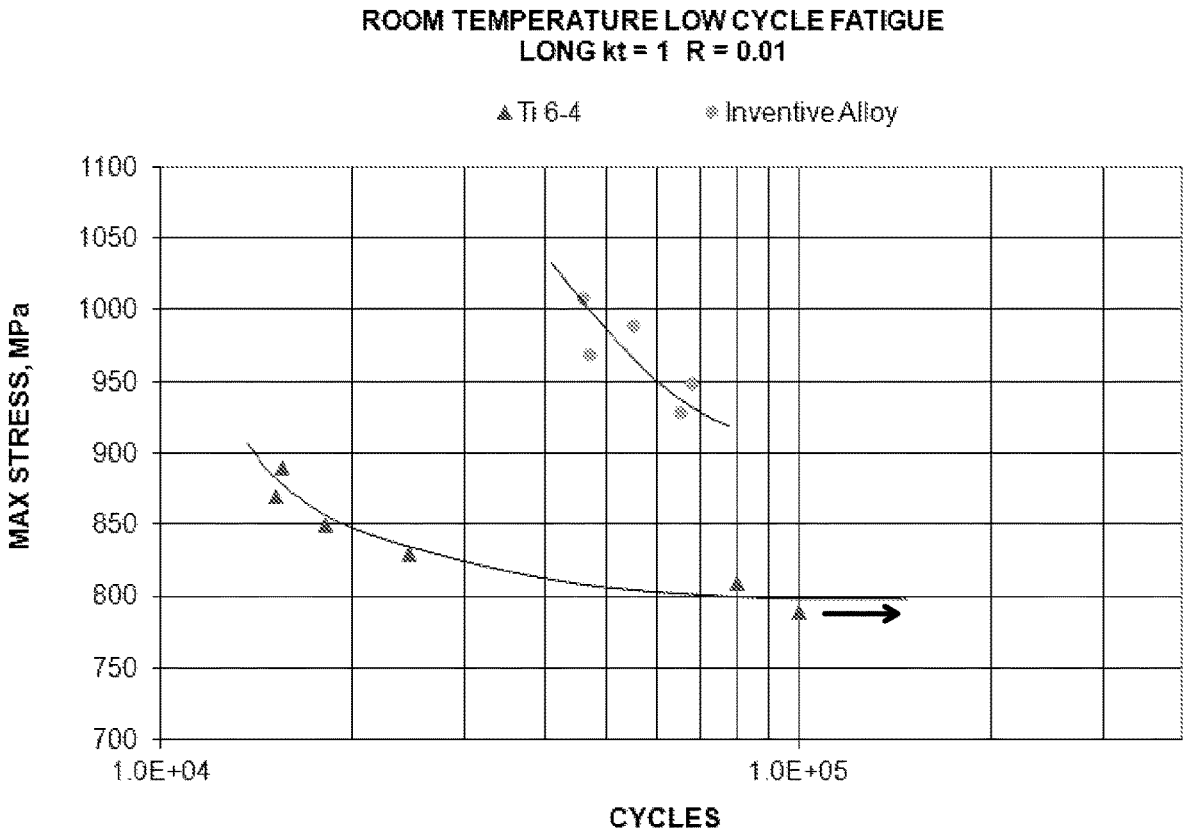

FIG. 4 graphically shows the results of low cycle fatigue tests using data provided in Table 9.

Figure 5A:
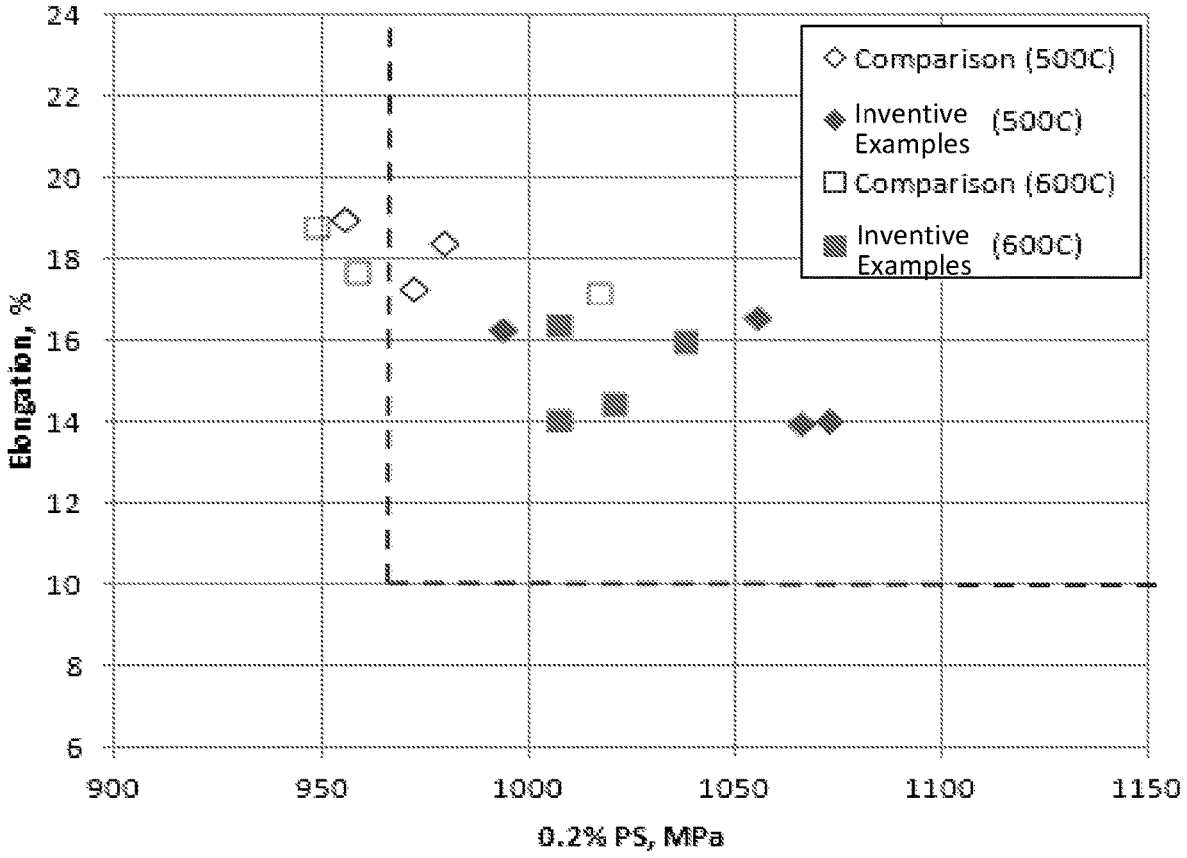

FIG. 5A graphically shows the results of tensile tests using data provided in Tables 11 and 12.

Figure 5B:
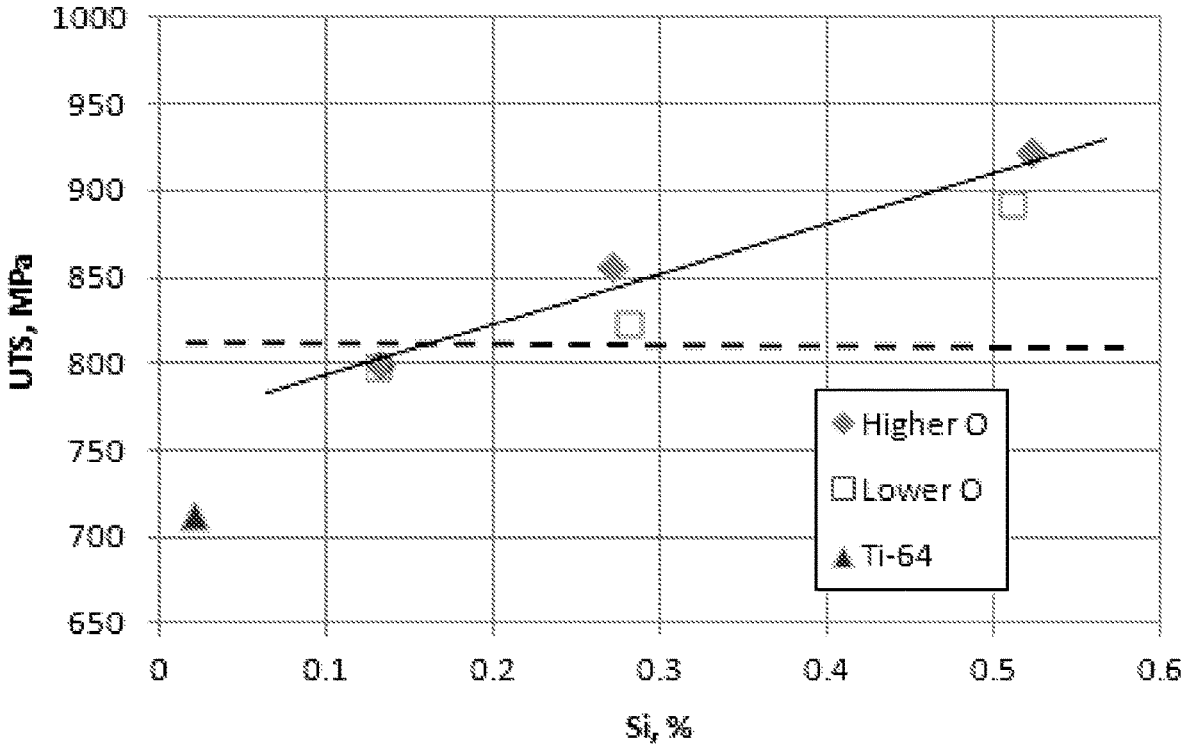

FIG. 5B graphically shows the results of tensile tests using data provided in Table 13.

Figure 6A:
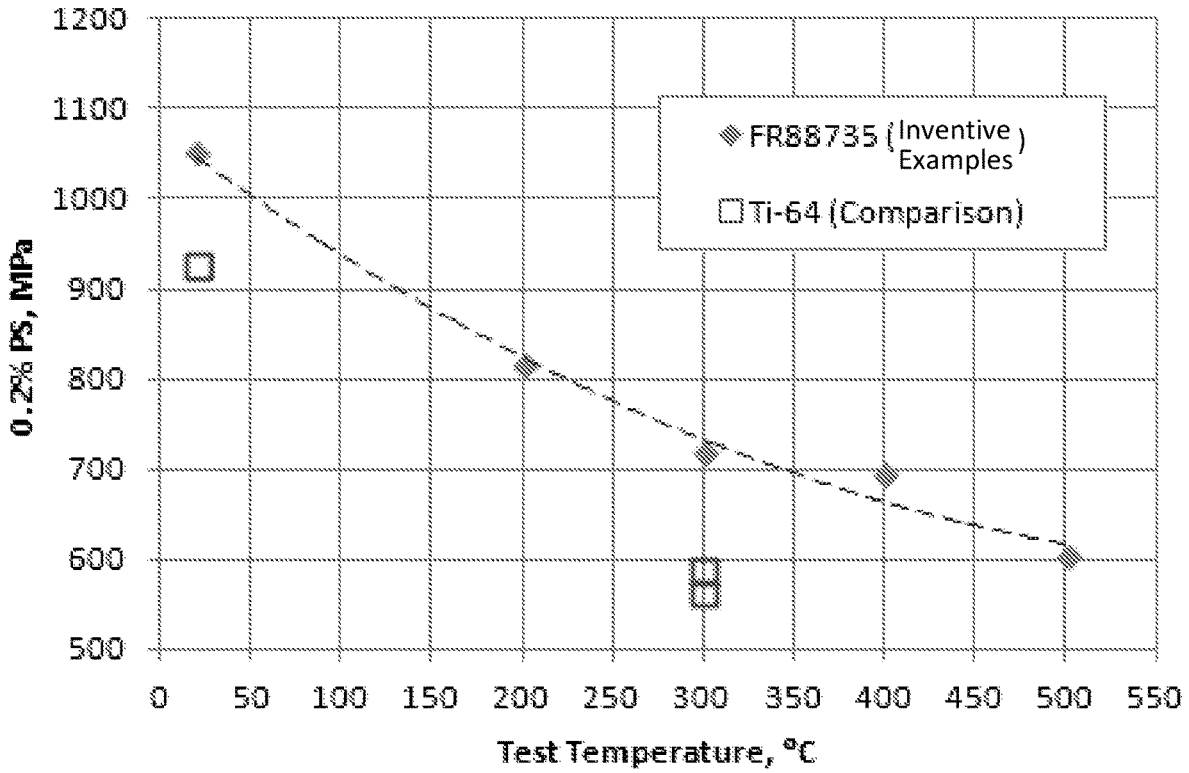

FIG. 6A graphically shows the results of elevated temperature tensile tests using data provided in Table 14.

Figure 6B:
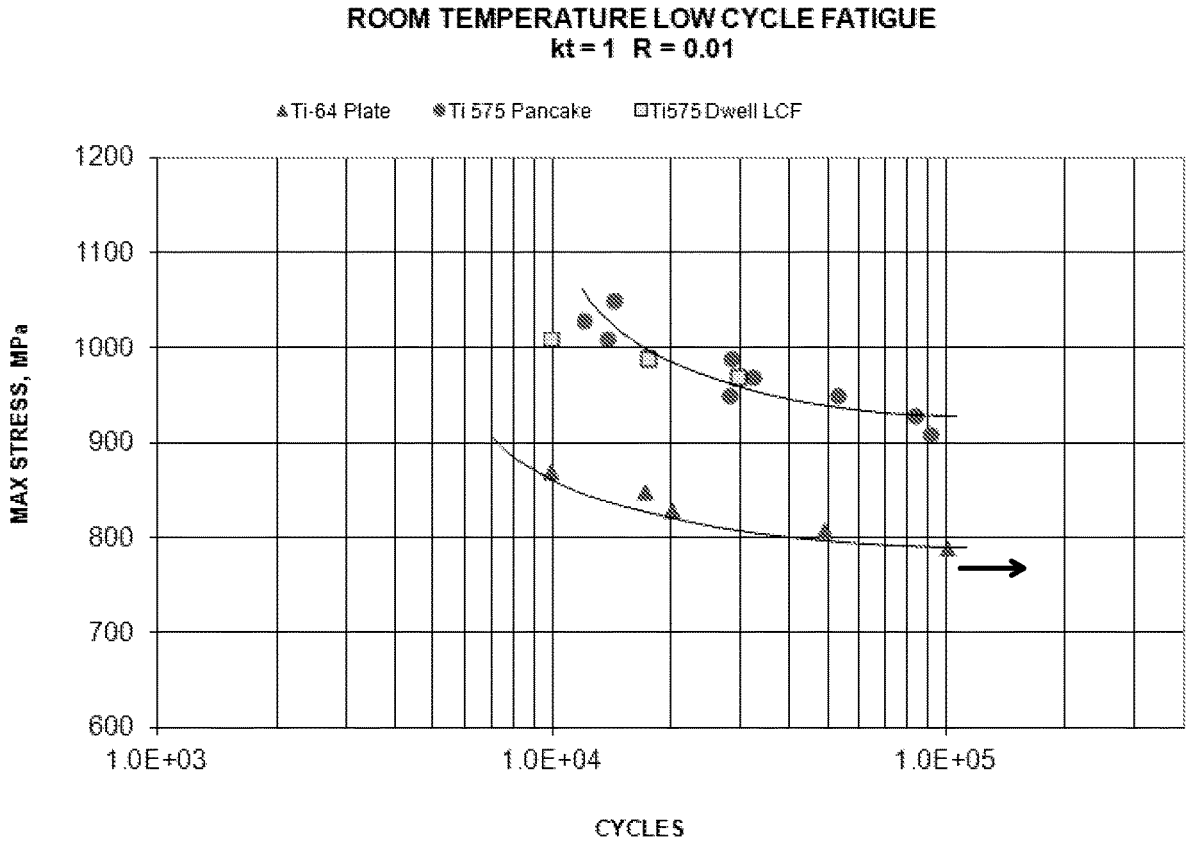

FIG. 6B graphically shows the results of standard (smooth surface) low cycle fatigue and dwell time low cycle fatigue tests.

Figure 6C:
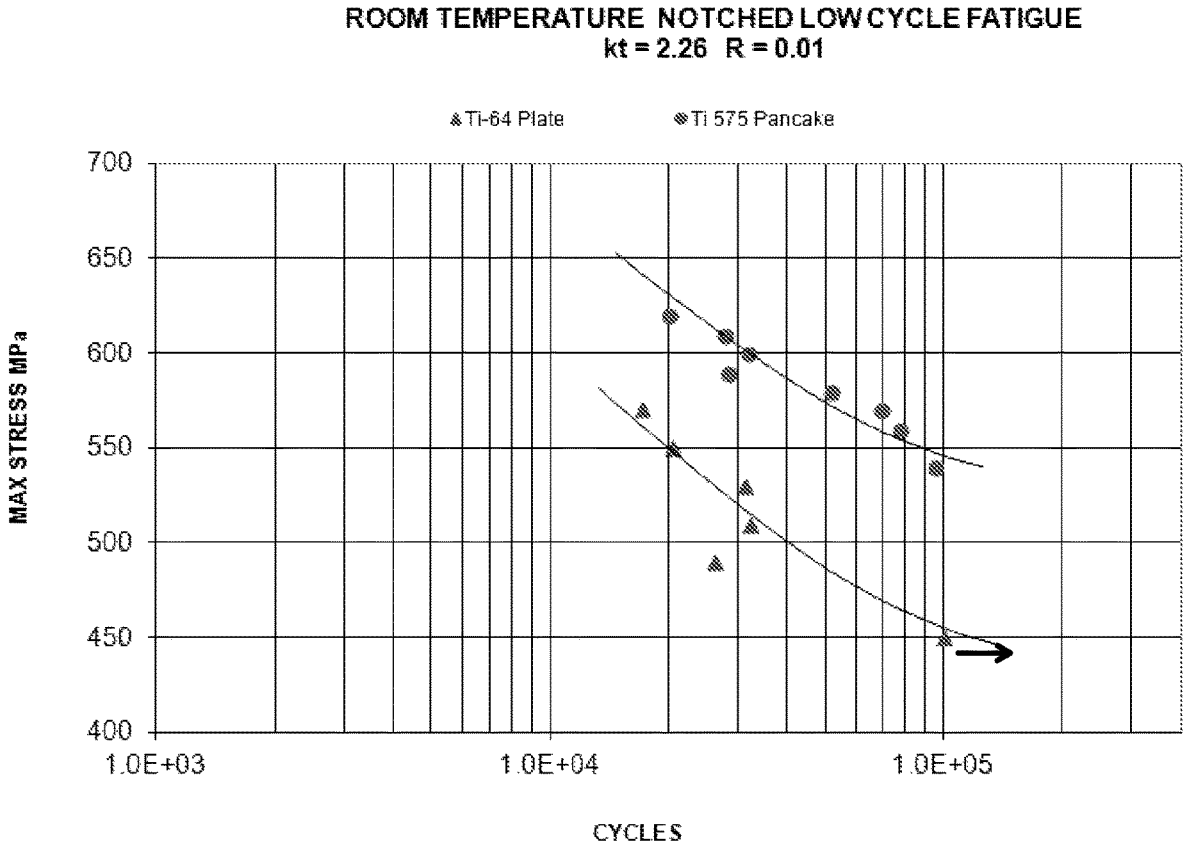

FIG. 6C graphically shows the results of notch low cycle fatigue tests.

Figure 6D:
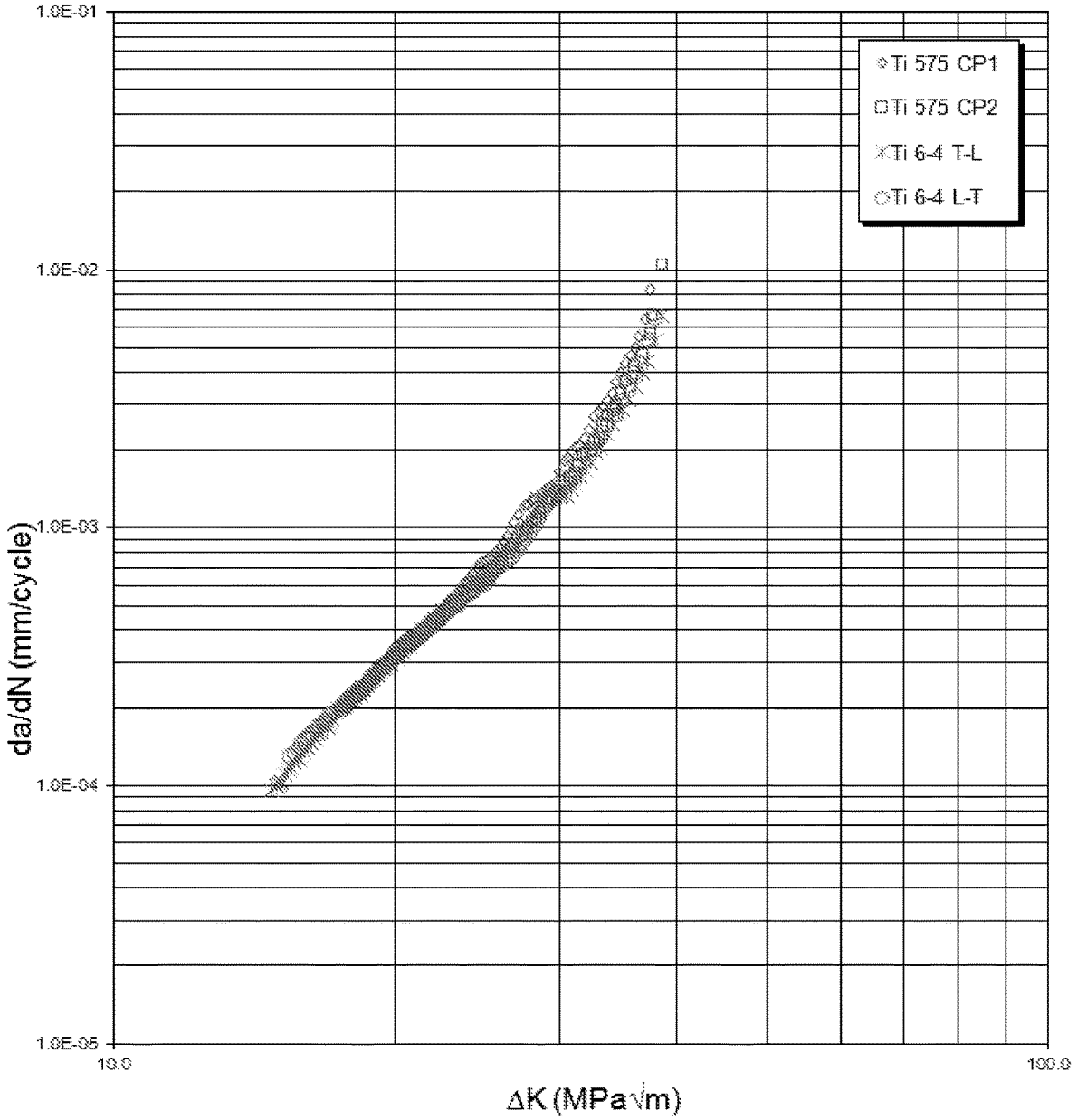

FIG. 6D graphically shows the results of fatigue crack growth rate tests.

DETAILED DESCRIPTION

A high-strength alpha-beta titanium alloy has been developed and is described herein. The alpha-beta titanium alloy includes Al at a concentration of from about 4.7 wt. % to about 6.0 wt. %; V at a concentration of from about 6.5 wt. % to about 8.0 wt. %; Si at a concentration of from about 0.15 wt. % to about 0.6 wt. %; Fe at a concentration of up to about 0.3 wt. %; 0 at a concentration of from about 0.15 wt. % to about 0.23 wt. %; and Ti and incidental impurities as a balance. The alpha-beta titanium alloy, which may be referred to as Timetal® 575 or Ti-575 in the present disclosure, has an Al/V ratio of from about 0.65 to about 0.8, where the Al/V ratio is defined as the ratio of the concentration of Al to the concentration of V in the alloy (each concentration being in weight percent (wt. %)).

The alpha-beta titanium alloy may optionally include one or more additional alloying elements selected from among Sn and Zr, where each additional alloying element is present at a concentration of less than about 1.5 wt. %, and the alloy may also or alternatively include Mo at a concentration of less than 0.6 wt. %. Carbon (C) may be present at a concentration of less than about 0.06 wt. %.

In some embodiments, the alpha-beta titanium alloy may include Al at a concentration of from about 5.0 to about 5.6 wt. %; V at a concentration of from about 7.2 wt. % to about 8.0 wt. %; Si at a concentration of from about 0.20 wt. % to about 0.50 wt. %; C at a concentration of from about 0.02 wt. % to about 0.08 wt. %; O at a concentration of from about 0.17 wt. % to about 0.22 wt. %, and Ti and incidental impurities as a balance. For example, the alloy may have the formula: Ti-5.3 Al-7.7V-0.2Fe-0.45Si-0.03C-0.20O, where the concentrations are in wt. %.

Individually, each of the incidental impurities may have a concentration of 0.1 wt. % or less. Together, the incidental impurities may have a total concentration of 0.5 wt. % or less. Examples of incidental impurities may include N, Y, B, Mg, Cl, Cu, H and/or C.

Since Ti accounts for the balance of the titanium alloy composition, the concentration of Ti in the alpha-beta Ti alloy depends on the amounts of the alloying elements and incidental impurities that are present. Typically, however, the alpha-beta titanium alloy includes Ti at a concentration of from about 79 wt. % to about 90 wt. %, or from about 81 wt. % to about 88 wt. %.

An explanation for the selection of the alloying elements for the alpha-beta titanium alloy is set forth below. As would be recognized by one of ordinary skill in the art, Al functions as an alpha phase stabilizer and V functions as a beta phase stabilizer.

Al may strengthen the alpha phase in alpha/beta titanium alloys by a solid solution hardening mechanism, and by the formation of ordered Ti3Al precipitates (shown in FIG. 1 as "DO19_TI3AL"). Al is a lightweight and inexpensive alloying element for titanium alloys. If the Al concentration is less than about 4.7 wt. %, sufficient strengthening may not be obtained after a heat treatment (e.g., a STA treatment). If the Al concentration exceeds 6.0 wt. %, an excessive volume fraction of ordered Ti3Al precipitates, which may reduce the ductility of the alloy, may form under certain heat treatment conditions. Also, an excessively high Al concentration may deteriorate the hot workability of the titanium alloy, leading to a yield loss due to surface cracks. Therefore, a suitable concentration range of Al is from about 4.7 wt. % to about 6.0 wt. %.

V is a beta stabilizing element that may have a similar strengthening effect as Mo and Nb. These elements may be referred to as beta-isomorphous elements that exhibit complete mutual solubility with beta titanium. V can be added to titanium in amounts up to about 15 wt. %; however, at such titanium concentrations, the beta phase may be excessively stabilized. If the V content is too high, the ductility is reduced due to a combination of solid solution strengthening, and refinement of the secondary alpha formed on cooling from solution treatment. Accordingly, a suitable V concentration may range from about 6.5 wt. % to about 8.0 wt. %. The reason for selecting V as a major beta stabilizer for the high strength alpha-beta titanium alloys disclosed herein is that V is a lighter element among various beta stabilizing elements, and master alloys are readily available for melting (e.g., vacuum arc remelting (VAR) or cold hearth melting). In addition, V has fewer issues with segregation in titanium alloys. A Ti—Al—V alloy system has an additional benefit of utilizing production experience with Ti-6Al-4V throughout the titanium production process—from melting to conversion. Also, Ti-64 scrap can be utilized for melting, which could reduce the cost of the alloy ingot.

By controlling the Al/V ratio to between 0.65 and 0.80, it may be possible obtain a titanium alloy having good strength and ductility. If the Al/V ratio is smaller than 0.65, the beta phase may become too stable to maintain the alpha/beta structure during thermo-mechanical processing of the material. If the Al/V ratio is larger than 0.80, hardenability of the alloy may be deteriorated due to an insufficient amount of the beta stabilizer.

Si can increase the strength of the titanium alloy by a solid solution mechanism and also a precipitation hardening effect through the formation of titanium silicides (see FIG. 5B). Si may be effective at providing strength and creep resistance at elevated temperatures. In addition, Si may help to improve the oxidation resistance of the titanium alloy. The concentration of Si in the alloy may be limited to about 0.6% since an excessive amount of Si may reduce ductility and deteriorate producibility of titanium billets raising crack sensitivity. If the content of Si is less than about 0.15%, however, the strengthening effect may be limited. Therefore, the Si concentration may range from about 0.15 wt. % to about 0.60 wt. %.

Fe is a beta stabilizing element that may be considered to be a beta-eutectoid element, like Si. These elements have restricted solubility in alpha titanium and may form intermetallic compounds by eutectoid decomposition of the beta phase. However, Fe is known to be prone to segregation during solidification of ingots. Therefore, the addition of Fe may be less than 0.3%, which is considered to be within a range that does not create segregation issues, such as "beta fleck" in the microstructure of forged products.

Oxygen (O) is one of the strongest alpha stabilizers in titanium alloys. Even a small concentration of O may strengthen the alpha phase very effectively; however, an excessive amount of oxygen may result in reduced ductility and fracture toughness of the titanium alloy. In Ti—Al—V alloy system, the maximum concentration of O may be considered to be about 0.23%. If the O concentration is less than 0.15%, however, a sufficient strengthening effect may not be obtained. The addition of other beta stabilizing elements or neutral elements selected from among Sn, Zr and Mo typically does not significantly deteriorate strength and ductility, as long as the addition is limited to about 1.5 wt. % for each of Sn and Zr, and 0.6 wt. % for Mo.

Although any of a variety of heat treatment methods may be applied to the titanium alloy, solution treatment and age (STA) may be particularly effective at maximizing strength and fatigue properties while maintaining sufficient ductility, as discussed further below. A strength higher than that of Ti-64 by at least by 15% may be obtained using STA even after air cooling from the solution treatment temperature. This is beneficial, as the center of large billets or forgings tend to be cooled slower than the exterior even when a water quench is applied.

The Si and O contents may be controlled to obtain sufficient strength at room and elevated temperatures after STA heat treatment without deteriorating other properties, such as elongation and low cycle fatigue life. The present disclosure also demonstrates that the Si content can be reduced when fracture toughness is critical for certain applications.

Figure 1A:
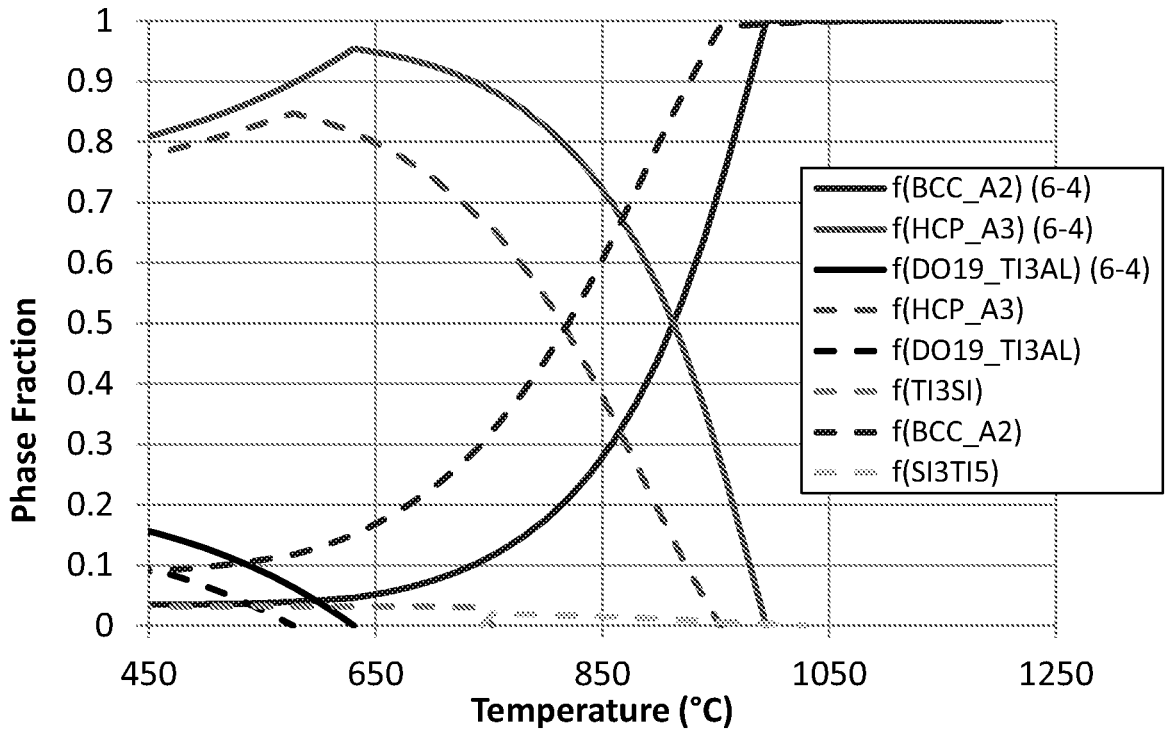
FIG. 1A shows phase diagrams of Ti-64 and Ti-575.

FIG. 1A shows phase diagrams of Ti-64 and Ti-575, the new high strength alpha/beta titanium alloy. The calculation was performed using PANDAT™ (CompuTherm LLC, Madison, Wis.). There are several notable differences between the two phase diagrams. Firstly, an amount of the $Ti_3Al$ phase in Ti-575 is less than in Ti-64. This may indicate that Ti-575 has less risk of ductility loss due to heat cycles at intermediate temperatures. Secondly, Ti-575 has a lower beta transus temperature, more beta phase at given heat treatment temperatures in the alpha/beta range, and a higher proportion of residual beta phase stable at low temperatures.

Figure 1B:
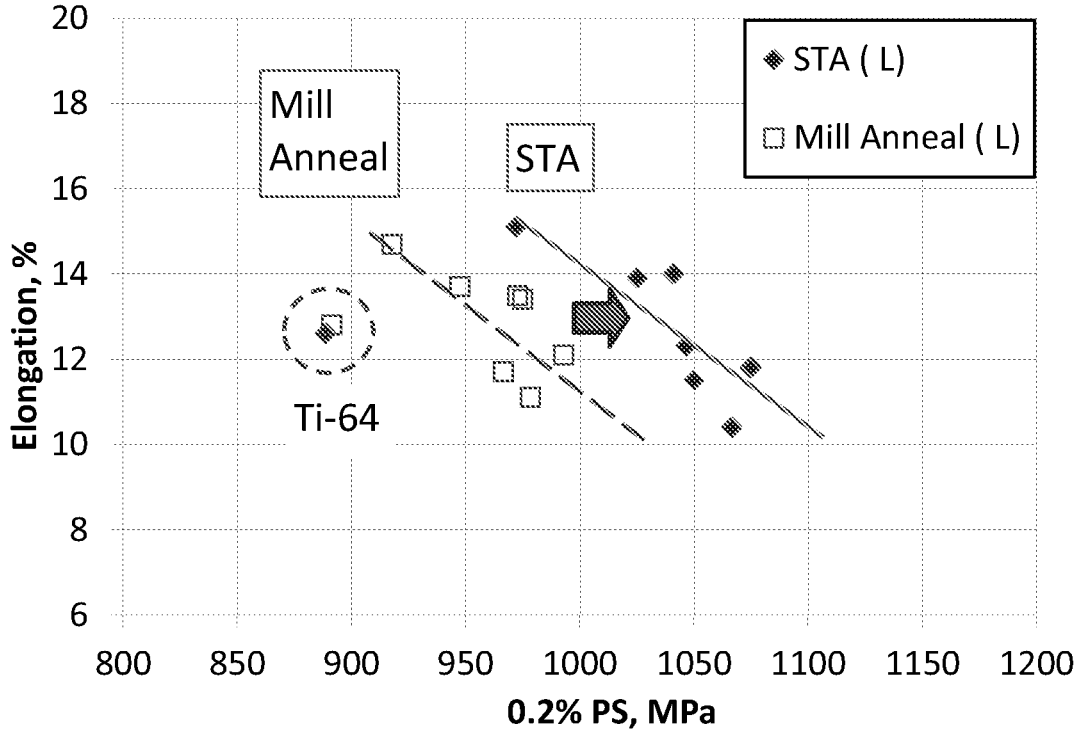
FIG. 1B shows the effect of heat treatments on the strength versus elongation relationship for exemplary inventive alloys and Ti-64, the comparative baseline alloy.

Following solution treatment and aging (STA), the alpha-beta titanium alloy may exhibit a yield strength at least 15% higher than that of Ti-6Al-4V processed using the same STA treatment. FIG. 1B shows the effect of heat treatment on the strength of Ti-575, and on a reference sample of Ti-64. The graph shows multiple data points for Ti-575 in the mill annealed and STA condition, arising from samples of varying experimental composition. In the mill annealed (700° C.) condition, Ti-575 exhibits the expected trend in which higher strength is accompanied by reduced ductility. In the STA condition (solution treated at 910° C. for 2 hours and then fan air cooled, followed by aging at 500° C. for 8 hours and air cooling) the strength of the Ti-575 samples is higher. The ductility would conventionally be expected to be correspondingly reduced so as to lie on the same trend line as the results from the mill annealed samples. In practice, however, the results for the STA condition are shifted to an approximately parallel trend line. This unexpected result is the basis for the improved combination of mechanical properties offered by Ti-575 relative to Ti 6-4. In addition to improved strength, the alpha-beta titanium alloy may also show a fatigue stress at least 10% higher than that of Ti-6Al-4V for a given number of cycles in low cycle fatigue and notch low cycle fatigue tests.

Figure 2A:
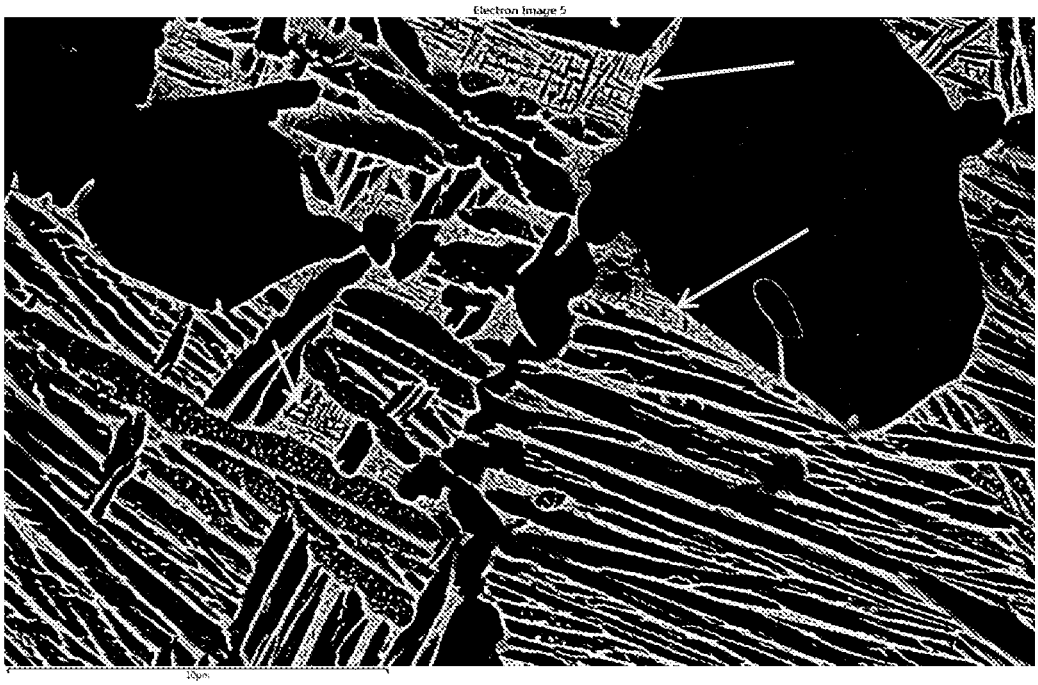
FIG. 2A shows a scanning electron microscope (SEM) image of a Ti-575 alloy after solution treatment at 910° C. for two hours followed by fan air cooling, and then aging at 500° C. for eight hours, followed by air cooling.
Figure 2B:
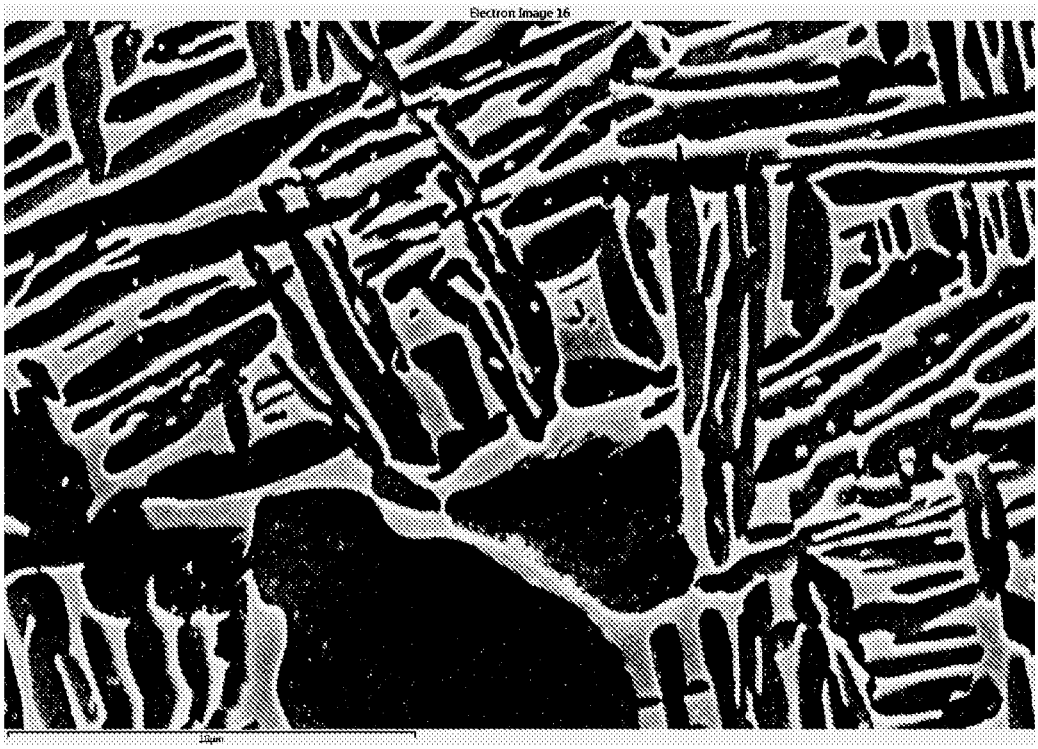
FIG. 2B shows a scanning electron microscope (SEM) image of a Ti-575 alloy after solution treatment at 910° C. for two hours followed by air cooling, and then annealing at 700° C. for two hours, followed by air cooling.

FIG. 2A shows a scanning electron microscope (SEM) images of an exemplary Ti-575 alloy that has been solution treated at 910° C. for 2 hours and then fan air cooled, followed by aging at 500° C. for 8 hours and then air cooling. In FIG. 2A, the microstructure of the alloy includes globular primary alpha phase particles; laths of secondary alpha in a beta phase matrix, formed during cooling from solution treatment; and tertiary alpha precipitates within the beta phase in the transformed structure, as indicated by the arrows. During solution treatment, the alloying elements in Ti-575 partition into the alpha and beta phases according to their affinities. During cooling from solution treatment, the secondary laths grow at a rate limited by the need to redistribute the solute elements. Since Ti-575 contains a higher proportion of beta stabilizing elements than Ti 64, the equilibrium proportion of beta phase at a given temperature is higher, and the kinetic barrier to converting beta to alpha is higher, so that for a given cooling curve, a higher proportion of beta phase may be retained in Ti-575. On subsequent aging at lower temperatures, the retained beta phase decomposes giving fine precipitates/tertiary laths of alpha phase and residual beta phase—PANDAT™ predicts about 9% in Ti-575, compared to about 3% in Ti 64. This combination of finer grain size and networks of residual ductile beta phase is believed to enable the improved ductility and fracture toughness for the STA condition shown in FIG. 1B and various examples below. Also during aging, on a scale too fine to resolve in FIG. 2A, the formation of silicide and carbide precipitates, and ordering of the alpha phase by aluminium and oxygen, are believed to occur and may augment the strength of the alloy. FIG. 2B shows a scanning electron microscope (SEM) image of a Ti-575 alloy after solution treatment at 910° C. for two hours followed by air cooling, and then annealing at 700° C. for two hours, followed by air cooling. This microstructure is coarser, lacking the tertiary alpha precipitates, and is consistent with the lower strength and ductility of the alloy in the annealed condition.

In other circumstances where it is preferable for the thermomechanical work or primary heat treatment of the alloy to be made above the beta transus, the primary alpha morphology may be coarse/acicular laths, but the principles of beta phase retention and subsequent decomposition with simultaneous precipitation of strengthening phases can still be applied to optimize the mechanical properties of the alloy.

As supported by the examples below, the high-strength alpha-beta titanium alloy may have a yield strength (0.2% offset yield stress or proof stress) at room temperature of at least about 965 MPa. The yield strength may also be least about 1000 MPa, at least about 1050 MPa, or at least about 1100 MPa. The yield strength may be at least about 15% higher than the yield strength of a Ti-6Al-4V alloy processed under substantially identical solution treatment and aging conditions. Depending on the composition and processing of the alpha-beta titanium alloy, the yield strength may be as high as about 1200 MPa, or as high as about 1250 MPa. For example, the yield strength may range from about 965 MPa to about 1000 MPa, from about 1000 MPa to about 1050 MPa, or from about 1050 MPa to about 1100 MPa, or from about 1100 MPa to about 1200 MPa. The modulus of the alpha-beta titanium alloy may be from about 105 GPa to about 120 GPa, and in some cases the modulus may be from about 111 GPa to about 115 GPa.

With proper design of the alloy composition, the high-strength alpha-beta titanium alloy may also exhibit a good strength-to-weight ratio, or specific strength, where the specific strength of a given alloy composition may be defined as 0.2% proof stress (or 0.2% offset yield stress) (MPa) divided by density ($g/cm^3$). For example, the high-strength alpha-beta titanium alloy may have a specific strength at room temperature of at least about 216 kN·m/kg, at least about 220 kN·m/kg, at least about 230 kN·m/kg, at least about 240 kN·m/kg, or at least about 250 kN·m/kg, where, depending on the composition and processing of the alloy, the specific strength may be as high as about 265 kN·m/kg. Typically, the density of the high-strength alpha-beta titanium alloy falls in the range of from about 4.52 $g/cm^3$ to about 4.57 $g/cm^3$, and may in some cases be in the range of from about 4.52 $g/cm^3$ and 4.55 $g/cm^3$.

As discussed above, the high-strength alpha-beta titanium alloy may exhibit a good combination of strength and ductility. Accordingly, the alloy may have an elongation of at least about 10%, at least about 12%, or at least about 14% at room temperature, as supported by the examples below. Depending on the composition and processing of the alloy, the elongation may be as high as about 16% or about 17%. Ideally, the high strength alpha-beta titanium alloy exhibits a yield strength as set forth above in addition to an elongation in the range of about 10 to about 17%. The ductility of the alloy may also or alternatively be quantified in terms of fracture toughness. As set forth in Table 11 below, the fracture toughness of the high-strength alpha-beta titanium alloy at room temperature may be at least about 40 $MPa \cdot m^{1/2}$, at least about 50 $MPa \cdot m^{1/2}$, at least about 65 $MPa \cdot m^{1/2}$, or at least about 70 $MPa \cdot m^{1/2}$. Depending on the composition and processing of the alloy, the fracture toughness may be as high as about 80 MPa·m$^{1/2}$.

The high-strength alpha-beta titanium alloy may also have excellent fatigue properties. Referring to Table 9 in the examples below, which summarizes the low cycle fatigue data, the maximum stress may be, for example, at least about 950 MPa at about 68000 cycles. Generally speaking, the alpha-beta titanium alloy may exhibit a maximum stress at least about 10% higher than the maximum stress achieved by a Ti-6Al-4V alloy processed under substantially identical solution treatment and aging conditions for a given number of cycles in low cycle fatigue tests.

A method of making a high-strength alpha-beta titanium alloy includes forming a melt comprising: Al at a concentration of from about 4.7 wt. % to about 6.0 wt. %; V at a concentration of from about 6.5 wt. % to about 8.0 wt. %; Si at a concentration of from about 0.15 wt. % to about 0.6 wt. %; Fe at a concentration of up to about 0.3 wt. %; O at a concentration of from about 0.15 wt. % to about 0.23 wt. %; and Ti and incidental impurities as a balance. An Al/V ratio is from about 0.65 to about 0.8, where the Al/V ratio is equal to the concentration of the Al divided by the concentration of the V in weight percent. The method further comprises solidifying the melt to form an ingot.

Vacuum arc remelting (VAR), electron beam cold hearth melting, and/or plasma cold hearth melting may be used to form the melt. For example, the inventive alloy may be melted in a VAR furnace with a multiple melt process, or a combination of one of the cold hearth melting methods and VAR melting may be employed.

The method may further comprise thermomechanically processing the ingot to form a workpiece. The thermomechanical processing may entail open die forging, closed die forging, rotary forging, hot rolling, and/or hot extrusion. In some embodiments, break down forging and a series of subsequent forging procedures may be similar to those applied to commercial alpha/beta titanium alloys, such as Ti-64.

The workpiece may then undergo a heat treatment to optimize the mechanical properties (e.g., strength, fracture toughness, ductility) of the alloy. The heat treating may entail solution treating and aging or beta annealing. The heat treatment temperature may be controlled relative to the beta transus of the titanium alloy. In a solution treatment and age process, the workpiece may be solution treated at a first temperature from about 150° C. to about 25° C. below beta transus, followed by cooling to ambient temperature by quenching; air cooling; or fan air cooling, according to the section of the workpiece and required mechanical properties. The workpiece may then be aged at a second temperature in the range of from about 400° C. to about 625° C.

The strengthening effect of the STA heat treatment may be evident when alpha-beta Ti alloys processed by STA are compared to alpha-beta Ti alloys processed by mill annealing. The strengthening may be due at least in part to stabilization of the beta phase by vanadium to avoid decomposition to coarse alpha laths plus thin beta laths, even after air cool. Fine alpha particles, silicides, and carbides can be precipitated during the aging step, which can be a source of higher strength. In beta annealing, the workpiece may be heated to a temperature slightly above the beta transus of the titanium alloy for a suitable time duration, followed by cooling (e.g., fan cooling or water quenching). Subsequently, the workpiece may be stress relieved; aged; or solution treated and aged.

As would be recognized by one of ordinary skill in the art, the beta transus for a given titanium alloy can be determined by metallographic examination or differential thermal analysis.

EXAMPLE A 10 button ingots weighing about 200 grams were made. Chemical compositions of the ingots are given in Table 2. In the table, Alloys 32 and 42 are exemplary Ti-575 alloys. Alloy 42 contains less than 0.6 wt. % Mo. Alloy Ti-64-2 has a similar composition to the commercial alloy Ti-64, which is a comparative alloy. Alloy 22 is a comparative alloy containing a lower concentration of vanadium. As a result, the Al/V ratio of the alloy 22 is higher than 0.80. Alloy 52 is Ti-64 alloy with a silicon addition; it is a comparative alloy as Al is too high and V is too low to satisfy the desired Al/V ratio.

The ingots were hot rolled to 0.5" (13 mm) square bars, and a solution treatment and age (STA) was applied to all of the bars. Tensile tests were performed on the bars after the STA at room temperature. Table 3 shows the results of the tensile tests.

TABLE 2

Chemical composition (in wt. %) and calculated density of experimental alloys

| ID | Al | V | Si | Fe | O | Mo | Al/V | Density g/cm$^3$ | Remarks |
|---|---|---|---|---|---|---|---|---|---|
| Ti-64-2 | 6.60 | 4.11 | 0.01 | 0.17 | 0.202 | 0.001 | 1.61 | 4.45 | Comparative |
| Alloy 22 | 5.39 | 6.42 | 0.48 | 0.25 | 0.200 | 0.002 | 0.84 | 4.50 | Comparative |
| Alloy 32 | 5.42 | 7.41 | 0.50 | 0.22 | 0.198 | 0.002 | 0.73 | 4.52 | Inventive Example |
| Alloy 42 | 5.41 | 6.90 | 0.52 | 0.20 | 0.201 | 0.57 | 0.78 | 4.54 | Inventive Example |
| Alloy 52 | 6.66 | 4.18 | 0.46 | 0.17 | 0.202 | 0.001 | 1.59 | 4.44 | Comparative |

Table 3 shows the tensile properties of the alloys after STA. Alloy 32 and 42 show noticeably higher proof strength or stress (PS) and ultimate tensile strength or stress (UTS) (0.2% PS>160 ksi (1107 MPa) and UTS>180 ksi (1245 MPa) than the comparative alloys. They also exhibit a higher specific strength, with values of 251 kN·m/kg and 263 kN·m/kg for alloys 32 and 42. Solution treatment and aging at a lower temperature for a longer time (500° C./8 hrs/AC) give rise to increased strength with sufficiently high ductility in the titanium alloys of the present disclosure.

TABLE 3

Tensile properties at room temperature after STA heat treatment

| ID | Heat Treatment | 0.2% PS MPa | 0.2% PS ksi | UTS MPa | UTS ksi | Elong. % | RA % | Specific Strength (0.2% PS) kN · m/kg | Specific Strength (UTS) kN · m/kg | Remarks |
|---|---|---|---|---|---|---|---|---|---|---|
| Ti-64-2 | 950° C./1 hr/AC + 500° C./8 hrs/AC | 921 | 133.6 | 1035 | 150.1 | 19.0 | 40.5 | 206.9 | 232.5 | Comparative |
| Alloy 22 | 930° C./1 hr/AC + 500° C./8 hrs/AC | 1082 | 156.9 | 1211 | 175.6 | 15.0 | 38.0 | 240.3 | 268.9 | Comparative |
| Alloy 32 | 900° C./1 hr/AC + 500° C./8 hrs/AC | 1134 | 164.5 | 1248 | 181.0 | 17.5 | 46.5 | 251.1 | 276.3 | Inventive Example |
| Alloy 42 | 900° C./1 hr/AC + 500° C./8 hrs/AC | 1193 | 173.0 | 1304 | 189.1 | 14.5 | 36.0 | 262.8 | 287.2 | Inventive Example |
| Alloy 52 | 950° C./1 hr/AC + 500° C./8 hrs/AC | 1071 | 155.3 | 1167 | 169.3 | 17.5 | 35.0 | 241.1 | 262.7 | Comparative |

EXAMPLE B

Eleven titanium alloy ingots were melted in a laboratory VAR furnace. The size of each of the ingots was 8" (203 mm) diameter with a weight of about 70 lbs (32 kg). Chemical compositions of the alloys are listed in Table 4. In the table, the Al/V ratio is given for each alloy. Alloys 69, 70, 72, 75, 76 and 85 are inventive alloys. Alloy 71 is a comparative alloy as the Si content is lower than 0.15%. Alloy 74 is a comparative Ti-64 alloy. Alloy 86 is a variation of Ti-64 with higher Al, higher V and higher O as compared with Alloy 74. Alloys 87 and 88 are comparative alloys containing lower concentrations of Al and higher concentrations of V. Alloy 75 and 88 contain approximately 1 wt. % of Zr and 1 wt. % each of Sn and Zr, respectively.

TABLE 4

Chemical composition (wt. %) and calculated density of experimental alloys

| ID | Al | V | Fe | Sn | Zr | Si | C | O | N | Al/V | Density g/cm$^3$ | Remarks |
|---|---|---|---|---|---|---|---|---|---|---|---|---|
| Alloy 69 | 4.93 | 7.36 | 0.22 | 0.01 | 0.00 | 0.45 | 0.030 | 0.190 | 0.006 | 0.67 | 4.53 | Inventive Example |
| Alloy 70 | 5.04 | 7.40 | 0.21 | 0.01 | 0.00 | 0.29 | 0.028 | 0.163 | 0.005 | 0.68 | 4.53 | Inventive Example |
| Alloy 71 | 5.13 | 7.56 | 0.21 | 0.01 | 0.00 | 0.09 | 0.030 | 0.159 | 0.006 | 0.68 | 4.53 | Comparison |
| Alloy 72 | 5.01 | 7.20 | 0.21 | 0.96 | 0.00 | 0.31 | 0.030 | 0.160 | 0.007 | 0.70 | 4.55 | Inventive Example |
| Alloy 75 | 5.31 | 7.69 | 0.22 | 0.01 | 1.14 | 0.29 | 0.032 | 0.166 | 0.004 | 0.69 | 4.55 | Inventive Example |
| Alloy 76 | 5.10 | 7.42 | 0.20 | 0.98 | 0.92 | 0.30 | 0.032 | 0.163 | 0.007 | 0.69 | 4.57 | Inventive Example |
| Alloy 74 | 6.16 | 4.03 | 0.19 | 0.01 | 0.00 | 0.02 | 0.027 | 0.176 | 0.004 | 1.53 | 4.46 | Comparison |
| Alloy 85 | 4.96 | 7.46 | 0.21 | 0.02 | 0.00 | 0.45 | 0.056 | 0.188 | 0.006 | 0.67 | 4.53 | Inventive Example |
| Alloy 86 | 6.79 | 4.37 | 0.20 | 0.02 | 0.00 | 0.02 | 0.036 | 0.185 | 0.008 | 1.55 | 4.45 | Comparison |
| Alloy 87 | 5.52 | 9.29 | 0.33 | 0.02 | 0.00 | 0.52 | 0.055 | 0.212 | 0.011 | 0.59 | 4.55 | Comparison |
| Alloy 88 | 6.06 | 9.01 | 0.21 | 1.06 | 1.13 | 0.37 | 0.031 | 0.187 | 0.007 | 0.67 | 4.58 | Comparison |

These ingots were soaked at 2100° F. (1149° C.) followed by forging to produce 5" (127 mm) square billets from 8" (203 mm) round ingots. Then, a first portion of the billet was heated at about 75° F. (42° C.) below the beta transus and then forged to a 2" (51 mm) square bar. A second portion of the 5" (127 mm) square billet was heated at about 75° F. below the beta transus and then forged to a 1.5" (38 mm) thick plate. The plate was cut into two parts. One part was heated at 50° F. (28° C.) below the beta transus and hot rolled to form a 0.75" (19 mm) plate. The other part of Alloys 85-88 were heated at 108° F. (60° C.) below the beta transus and hot-rolled to 0.75" (19 mm) plates.

Tensile coupons were cut along both the longitudinal (L) and transverse (T) directions from the 0.75" (019 mm) plates. These coupons were solution treated at 90° F. (50° C.) below the beta transus for 1.5 hours, and then air cooled to ambient temperature followed by aging at 940° F. (504° C.) for 8 hours, followed by air cooling. Tensile tests were performed at room temperature in accordance with ASTM E8. Two tensile tests were performed for each condition; therefore, each of the values in Tables 5-6 represent the average of two tests.

Table 5 shows the results of room temperature tensile tests of 0.75" (19 mm) plates after STA heat treatment. FIGS. 3A and 3B display the relationship between 0.2% PS and elongation using the values in Table 5 for the longitudinal and transverse directions, respectively. In the figures, a top-right square surrounded by two dotted lines is a target area for a good balance of strength and ductility. As a general trend, a trade-off between strength and elongation can be observed in most of the titanium alloys. The inventive alloys exhibit a good balance of strength and ductility, exhibiting a 0.2% PS higher than about 140 ksi (965 MPa) (typically higher than 150 ksi (1034 MPa)) and elongation higher than 10%. The specific strengths for the exemplary inventive titanium alloys lie between about 225 kN·m/kg and 240 kN·m/kg (based on 0.2% PS). It should be noted that the elongation for Alloy 85 was 9.4%, which is the average of the elongation of two tests, 10.6% and 8.2%, respectively. The result indicates that Alloy 85 is at a borderline of the range of preferred titanium alloy compositions, which may be due to the higher C and higher Si contents of the alloy.

TABLE 5

Results of tensile tests at room temperature after STA heat treatment

| ID | Alloy | Direction | 0.2% PS Mpa | 0.2% PS ksi | UTS MPa | UTS ksi | El % | RA % | Modulus GPa | Modulus msi | Specific Strength (0.2% PS) kN · m/kg | Specific Strength (UTS) kN · m/kg | Remarks |
|---|---|---|---|---|---|---|---|---|---|---|---|---|---|
| Alloy 69 | Ti—5.3Al 7.5V 0.5Si | Long | 1047 | 151.8 | 1145 | 166.1 | 12.3 | 33.8 | 114 | 16.6 | 231.2 | 253.0 | Inventive Example |
| Alloy 70 | Ti 5.3Al 7.5V 0.35Si | Long | 1025 | 148.7 | 1115 | 161.7 | 13.9 | 47.5 | 114 | 16.6 | 226.4 | 246.2 | Inventive Example |
| Alloy 71 | Ti 5.3Al 7.5V 0.1Si | Long | 972 | 141.0 | 1053 | 152.7 | 15.1 | 42.9 | 118 | 17.1 | 214.4 | 232.2 | Comparison |
| Alloy 72 | Ti 5.3Al 7.5V 1Sn 0.35Si | Long | 1041 | 151.0 | 1132 | 164.2 | 14.0 | 42.5 | 114 | 16.6 | 228.7 | 248.7 | Inventive Example |
| Alloy 75 | Ti 5.3Al 7.5V 1Zr 0.35Si | Long | 1067 | 154.7 | 1198 | 173.8 | 10.4 | 27.6 | 113 | 16.4 | 234.3 | 263.3 | Inventive Example |
| Alloy 76 | Ti 5.3Al 7.5V 1Sn 1Zr 0.35Si | Long | 1075 | 155.9 | 1211 | 175.6 | 11.8 | 36.0 | 111 | 16.1 | 235.0 | 264.8 | Inventive Example |
| Alloy 74 | Ti 6.15Al 4.15V | Long | 889 | 128.9 | 989 | 143.4 | 12.6 | 30.4 | 117 | 17.0 | 199.3 | 221.7 | Comparison |
| Alloy 85 | Ti 5.3Al 7.5V 0.5Si 0.05C 0.19O | Long | 1050 | 152.3 | 1163 | 166.7 | 11.5 | 28.9 | 113 | 16.4 | 232.0 | 256.9 | Inventive Example |
| Alloy 86 | Ti 6.5Al 4.15V 0.025C 0.2O | Long | 893 | 129.5 | 973 | 141.1 | 14.9 | 47.9 | 117 | 17.0 | 200.5 | 218.4 | Comparison |
| Alloy 87 | Ti 5.8Al 9V 0.5Si 0.05C 0.21O | Long | 1159 | 168.1 | 1275 | 184.9 | 9.0 | 24.3 | 114 | 16.6 | 254.9 | 280.4 | Comparison |
| Alloy 88 | Ti 5.8Al 8.5V 1Sn 1Zr 0.35Si 0.025C 0.19O | Long | 1121 | 162.6 | 1258 | 182.4 | 11.0 | 33.1 | 111 | 16.1 | 244.5 | 274.3 | Comparison |
| Alloy 69 | Ti 5.3Al 7.5V 0.5Si | Trans | 1025 | 148.7 | 1128 | 163.6 | 12.4 | 37.8 | 112 | 16.3 | 226.5 | 249.2 | Inventive Example |
| Alloy 70 | Ti 5.3Al 7.5V 0.35Si | Trans | 1027 | 149.0 | 1111 | 161.2 | 12.3 | 42.0 | 115 | 16.7 | 226.8 | 245.4 | Inventive Example |
| Alloy 71 | Ti 5.4Al 7.5V 0.1Si | Trans | 945 | 137.1 | 1018 | 147.6 | 13.1 | 43.4 | 105 | 15.3 | 208.5 | 224.4 | Comparison |
| Alloy 72 | Ti 5.3Al 7.5V 1Sn 0.35Si | Trans | 1054 | 152.8 | 1133 | 164.3 | 14.0 | 46.2 | 115 | 16.7 | 231.4 | 248.8 | Inventive Example |
| Alloy 75 | Ti 5.3Al 7.5V 1Sn 0.35Si | Trans | 1051 | 152.5 | 1184 | 171.7 | 11.8 | 41.4 | 111 | 16.1 | 231.0 | 260.1 | Inventive Example |
| Alloy 76 | Ti 5.3Al 7.5V 1Sn 1Zr 0.35Si | Trans | 1083 | 157.1 | 1202 | 174.3 | 12.6 | 43.6 | 112 | 16.2 | 236.9 | 262.8 | Inventive Example |
| Alloy 74 | Ti 6.15Al 4.15V | Trans | 936 | 135.8 | 1031 | 149.5 | 15.1 | 34.9 | 123 | 17.8 | 209.9 | 231.1 | Comparison |
| Alloy 85 | Ti 5.3Al 7.5V 0.5Si 0.05C 0.19O | Trans | 1084 | 157.2 | 1179 | 171.0 | 9.4 | 28.1 | 119 | 17.2 | 239.4 | 260.4 | Inventive Example |
| Alloy 86 | Ti 6.5Al 4.15V 0.025C 0.2O | Trans | 949 | 137.7 | 1029 | 149.3 | 15.8 | 40.4 | 128 | 18.6 | 213.1 | 231.1 | Comparison |
| Alloy 87 | Ti 5.8Al 9V 0.5Si 0.05C 0.21O | Trans | 1159 | 168.1 | 1281 | 185.8 | 8.8 | 17.6 | 115 | 16.7 | 254.9 | 281.7 | Comparison |
| Alloy | Ti 5.8Al 8.5V 1Sn 1Zr 0.35Si 0.025C 0.19O | Trans | 1151 | 166.9 | 1296 | 187.9 | 10.7 | 29.7 | 113 | 16.4 | 251.0 | 282.6 | Comparison |

Two different conditions were used for solution treatment and aging of the 2" square bar: solution treat at 50° F. (28° C.) below beta transus for 1.5 hours then air cool, followed by aging at 940° F. (504° C.) for 8 hours, then air cooling (STA-AC); and solution treat at 50° F. (28° C.) below beta transus for 1.5 hours then fan air cool, followed by aging at 940° F. (504° C.) for 8 hours, then air cooling (STA-FAC).

Air cooling from the solution treatment temperature results in a material bearing greater similarity to the center of thick section forged parts, while fan air cooling from the solution treatment temperature results in a material bearing closer similarity to the surface of a thick section forged part after water quenching. The results of tensile tests at room temperature are given in Table 6. The results are also displayed in FIG. 3C graphically.

TABLE 6

Results of tensile tests at room temperature of experimental alloys after STA

| ID | Alloy | Direction | 0.2% PS Mpa | 0.2% PS ksi | UTS MPa | UTS ksi | El % | RA % | Modulus GPa | Modulus msi | Specific Strength (0.2% PS) kN · m/kg | Specific Strength (UTS) kN · m/kg | Remarks |
|---|---|---|---|---|---|---|---|---|---|---|---|---|---|
| Alloy 69 | Ti 5.3Al 7.5V 0.5Si | AC | 987 | 143.1 | 1094 | 158.7 | 15.7 | 50.2 | 106 | 15.7 | 218.0 | 241.8 | Inventive Example |
| Alloy 70 | Ti 5.3Al 7.5V 0.35Si | AC | 961 | 139.4 | 1048 | 152.0 | 16.4 | 59.3 | 109 | 15.8 | 212.2 | 231.4 | Inventive Example |
| Alloy 71 | Ti 5.3Al 7.5V 0.1Si | AC | 914 | 132.5 | 1000 | 145.1 | 18.0 | 60.6 | 108 | 15.37 | 201.5 | 220.6 | Comparison |
| Alloy 72 | Ti 5.3Al 7.5V 1Sn 0.35Si | AC | 1015 | 147.2 | 1121 | 162.6 | 15.7 | 54.0 | 108 | 15.6 | 222.9 | 246.3 | Inventive Example |
| Alloy 75 | Ti 5.3Al 7.5V 1Zr 0.35Si | AC | 1007 | 146.1 | 1138 | 165.0 | 15.1 | 51.1 | 106 | 15.4 | 221.3 | 249.9 | Inventive Example |
| Alloy 76 | Ti 5.3Al 7.5V 1Sn 1Zr 0.35Si | AC | 987 | 143.2 | 1121 | 162.6 | 15.7 | 54.8 | 105 | 15.3 | 215.9 | 245.2 | Inventive Example |
| Alloy 74 | Ti 6.15Al 4.15V | AC | 870 | 126.2 | 967 | 140.3 | 16.0 | 48.5 | 114 | 16.5 | 195.1 | 216.9 | Comparison |
| Alloy 85 | Ti 5.3Al 7.5V 0.5Si 0.05C 0.19O | AC | 1055 | 153.0 | 1180 | 171.1 | 10.9 | 32.2 | 109 | 15.8 | 233.0 | 260.5 | Inventive Example |
| Alloy 86 | Ti 6.5Al 4.15V 0.025C 0.2O | AC | 903 | 130.9 | 992 | 143.9 | 16.5 | 50.0 | 114 | 16.5 | 202.6 | 222.7 | Comparison |
| Alloy 88 | Ti 5.8Al 8.5V 1Sn 1Zr 0.35Si 0.025C 0.19O | AC | 1143 | 165.8 | 1257 | 182.3 | 12.2 | 37.9 | 108 | 15.7 | 249.3 | 274.1 | Comparison |
| Alloy 69 | Ti 5.3Al 7.5V 0.5Si | FAC | 985 | 142.9 | 1109 | 160.8 | 15.8 | 53.0 | 109 | 15.8 | 217.7 | 245.0 | Inventive Example |
| Alloy 70 | Ti 5.3Al 7.5V 0.35Si | FAC | 981 | 142.3 | 1091 | 158.3 | 17.0 | 55.7 | 110 | 16.0 | 216.6 | 241.0 | Inventive Example |
| Alloy 71 | Ti 5.4Al 7.5V 0.1Si | FAC | 933 | 135.3 | 1037 | 150.4 | 17.2 | 58.9 | 110 | 16.0 | 205.7 | 228.7 | Comparison |
| Alloy 72 | Ti 5.3Al 7.5V 1Sn 0.35Si | FAC | 1049 | 152.1 | 1158 | 167.9 | 15.1 | 56.3 | 110 | 15.9 | 230.4 | 254.3 | Inventive Example |
| Alloy 75 | Ti 5.3Al 7.5V 1Sn 0.35Si | FAC | 1011 | 146.6 | 1158 | 167.9 | 15.4 | 54.6 | 108 | 15.7 | 222.1 | 254.3 | Inventive Example |
| Alloy 76 | Ti 5.3Al 7.5V 1Sn 1Zr 0.35Si | FAC | 1021 | 148.1 | 1174 | 170.3 | 15.4 | 53.2 | 108 | 15.6 | 223.3 | 256.8 | Inventive Example |
| Alloy 74 | Ti 6.15Al 4.15V | FAC | 893 | 129.5 | 987 | 143.1 | 15.3 | 49.3 | 115 | 16.7 | 200.2 | 221.2 | Comparison |
| Alloy 85 | Ti 5.3Al 7.5V 0.5Si 0.05C 0.19O | FAC | 1090 | 158.1 | 1226 | 177.8 | 11.1 | 31.8 | 109 | 15.8 | 240.8 | 270.8 | Inventive Example |
| Alloy 86 | Ti 6.5Al 4.15V 0.025C 0.2O | FAC | 929 | 134.7 | 1027 | 149.0 | 14.9 | 46.8 | 116 | 16.8 | 208.5 | 230.6 | Comparison |
| Alloy 88 | Ti 5.8Al 8.5V 1Sn 1Zr 0.35Si 0.025C 0.19O | FAC | 1243 | 180.3 | 1354 | 196.4 | 7.9 | 20.3 | 109 | 15.8 | 271.1 | 295.3 | Comparison |

FIG. 3C shows a similar trend where elongation decreases with increasing strength. Alloys processed with the STA-FAC (fan air cool after solution treatment) condition exhibit a slightly higher strength than alloys processed with the STA-AC. It should be noted that Alloy 88 exhibited very high strength but low ductility after STA-FAC due to excessive hardening; in contrast, after air cooling (STA-AC), the properties of Alloy 88 were satisfactory. The inventive alloys display a fairly consistent strength/ductility balance regardless of the cooling method after solution treatment.

FIG. 1B shows a strength versus elongation relationship of the inventive alloys and Ti-64 (Comparative baseline alloy) following STA and mill anneal (MA) conditions. The cooling after solution treatment was air cooling. It is evident from FIG. 1B that Ti-64 shows little change between STA and MA conditions; however, in the inventive alloys a significant strengthening is observed after STA without deterioration of elongation. This is due to excellent hardenability of the inventive alloys as compared with Ti-64.

EXAMPLE C

A laboratory ingot with a diameter of 11" (279 mm) and weight of 196 lb (89 kg) was made. The chemical composition of the ingot (Alloy 95) was Al: 5.42 wt. %, V: 7.76 wt. %, Fe; 0.24 wt. %, Si:0.46 wt. %, C: 0.06 wt. %, O: 0.205 wt. %, with a balance of titanium and inevitable impurities. The ingot was soaked at 2100° F. (1149° C.) for 6 hours, then breakdown forged to an 8" (203 mm) square billet. The billet was heated at 1685° F. (918° C.) for 4 hours followed by forging to a 6.5" (165 mm) square billet. Then, a part of the billet was heated to 1850° F. (1010° C.) followed by forging to a 5.5" (140 mm) square billet. A part of the 5.5" square billet was then heated at 1670° F. (910° C.) for 2 hours followed by forging to a 2" (51 mm) square bar. Square tensile coupons were cut from the 2" square bar, then a solution treatment and age was performed. The temperature and time of the solution treatment were changed. After the solution treatment, the coupons were fan air cooled to ambient temperature, followed by aging at 940° F. (504° C.) for 8 hours, then air cooling. Tensile tests were performed at room temperature. Table 7 shows for each condition the average of two tests. As can be in the table, the values for 0.2% PS are substantially higher than the minimum requirement of 140 ksi (965 MPa) with a satisfactory elongation (e.g., higher than 10%).

TABLE 7

Results of RT tensile tests of 2" (51 mm) square billet of Alloy 95 after various STA heat treatments

| Heat Treatment | 0.2% PS | | UTS | | El | RA | Modulus | |
|---|---|---|---|---|---|---|---|---|
| Condition | MPa | ksi | MPa | ksi | % | % | GPa | msi |
| 752° C./1 hr/FAC-504° C./8 hr/AC | 1156 | 167.7 | 1199 | 173.9 | 11.7 | 36.7 | 114 | 16.6 |
| 752° C./5 hr/FAC-504° C./8 hr/AC | 1174 | 170.3 | 1224 | 177.6 | 11.9 | 37.3 | 115 | 16.7 |
| 802° C./1 hr/FAC-504° C./8 hr/AC | 1204 | 174.6 | 1272 | 184.5 | 11.3 | 35.6 | 114 | 16.5 |
| 802° C./5 hr/FAC-504° C./8 hr/AC | 1206 | 174.9 | 1287 | 186.7 | 11.6 | 37.1 | 114 | 16.5 |
| 852° C./1 hr/FAC-504° C./8 hr/AC | 1193 | 173.1 | 1263 | 183.2 | 11.9 | 41.9 | 112 | 16.3 |
| 852° C./5 hr/FAC-504° C./8 hr/AC | 1229 | 178.3 | 1318 | 191.2 | 10.7 | 37.7 | 111 | 16.1 |

A part of the material at 5.5" (140 mm) square was hot-rolled to 0.75" (19 mm) plate after heating at 1670° F. (910° C.) for 2 hours. Then test coupons were cut along both longitudinal and transverse directions. A STA heat treatment (1670° F. (910° C.)/1 hr/air cool then 940° F.(504° C.)/8 hrs/air cool) was performed on the coupons. Table 8 shows the results of tensile tests at room temperature and 500° F. (260° C.). The results clearly indicate that higher strengths (>140 ksi) (965 MPa)) and satisfactory elongation values (>10%) are obtained.

TABLE 8

Tensile properties of plate of Alloy 95 after STA heat treatment

| | Heat treatment | Test | Direc- | 0.2% PS | | UTS | | El | RA |
|---|---|---|---|---|---|---|---|---|---|
| ID | Condition | Temp. | tion | MPa | ksi | MPa | ksi | % | % |
| Alloy 95 | 910° C./1 hr/AC + 504° C./8 hr/AC | RT | L | 1083 | 157.1 | 1178 | 170.8 | 13 | 37.7 |
| | | | T | 1069 | 155.1 | 1159 | 168.1 | 14 | 39.0 |
| | | 260° C. | L | 786 | 114.0 | 929 | 134.8 | 16 | 50.0 |
| | | | T | 774 | 112.3 | 926 | 134.3 | 18 | 52.5 |

Low cycle fatigue (LCF) test specimens were machined from STA heat treated coupons. The fatigue testing was carried out at the condition of Kt=1 and R=0.01 using stress control, and the frequency was 0.5 Hz. The testing was discontinued at $10^5$ cycles. Table 9 and FIG. 4 show the results of the LCF test, where the LCF curve is compared with fatigue data from Ti-64. It is evident from FIG. 4 that the inventive alloy exhibits superior LCF properties compared to the commercial alloy Ti-64.

TABLE 9

LCF test result of Alloy 95 plate

| Max Stress | | |
|---|---|---|
| ksi | MPa | Cycles |
| 137.8 | 950 | 67711 |
| 134.9 | 930 | 64803 |
| 140.7 | 970 | 46736 |
| 143.6 | 990 | 54867 |
| 146.5 | 1010 | 45829 |

EXAMPLE D

Seven titanium alloys ingots were melted in a laboratory VAR furnace. The size of the ingots was 8" (203 mm) diameter with a weight of about 70 lbs (32 kg). Chemical compositions of the alloys are listed in Table 10. In the table, the Al/V ratio is given for each alloy. Alloy 163 is Ti-64 containing a slightly higher oxygen concentration. Alloy 164 through Alloy 167 are within the inventive composition range. Alloys 168 and 169 are comparative alloys, as the silicon content is lower than 0.15%.

TABLE 10

Chemical composition (wt. %) and calculated densities of experimental alloys

| | Al | V | Fe | Si | C | O | N | Al/V | Density g/cm$^3$ | Note |
|---|---|---|---|---|---|---|---|---|---|---|
| Alloy 163 | 6.54 | 4.11 | 0.17 | 0.02 | 0.034 | 0.219 | 0.005 | 1.59 | 4.45 | Ti-64, Comparison |
| Alloy 164 | 5.43 | 7.80 | 0.21 | 0.52 | 0.036 | 0.209 | 0.007 | 0.70 | 4.52 | Inventive Example |
| Alloy 165 | 5.56 | 7.51 | 0.21 | 0.51 | 0.035 | 0.185 | 0.004 | 0.74 | 4.52 | Inventive Example |
| Alloy 166 | 5.42 | 7.69 | 0.21 | 0.27 | 0.038 | 0.207 | 0.003 | 0.70 | 4.52 | Inventive Example |
| Alloy 167 | 5.30 | 7.54 | 0.20 | 0.28 | 0.036 | 0.178 | 0.004 | 0.70 | 4.53 | Inventive Example |
| Alloy 168 | 5.33 | 7.60 | 0.22 | 0.13 | 0.035 | 0.205 | 0.005 | 0.70 | 4.53 | Comparison |
| Alloy 169 | 5.31 | 7.55 | 0.20 | 0.13 | 0.036 | 0.166 | 0.004 | 0.70 | 4.53 | Comparison |

These ingots were soaked at 2100° F. (1149° C.) for 5 hours, followed by forging to a 6.5" (165 mm) square billet. The billet was heated at 45° F. (25° C.) below the beta transus for 4 hours, followed by forging to a 5" (127 mm) square billet. Then the billet was heated approximately 120° F. (67° C.) above the beta transus, followed by forging to a 4" (102 mm) square billet. The billets were water quenched after the forging. The billets were further forged down to 2" (51 mm) square bars after being heated at approximately 145° F. (81° C.) below the beta transus. Solution treatment was performed on the 2" (51 mm) square bar, then tensile test coupons for the longitudinal direction and compact tension coupons for L-T testing were cut. Solution treatment was performed at 90° F. (50° C.) below beta transus, designated as TB-90F. Aging was performed on the coupons at two different conditions, 930° F. (499° C.) for 8 hours or 1112° F. (600° C.) for 2 hours. Tables 11 and 12 show the results of tensile tests and fracture toughness tests. FIG. 5A shows the tensile test results graphically.

TABLE 11

Results of room temperature tensile tests and fracture toughness tests after STA heat treatment

| | | | | 0.2% PS | | UTS | | El | RA | Specific Strength (0.2% PS) | Specific Strength (UTS) | $K_{IC}$ | | |
|---|---|---|---|---|---|---|---|---|---|---|---|---|---|---|
| ID | Alloy | ST | Aging | MPa | ksi | MPa | ksi | % | % | kN · m/kg | kN · m/kg | MPa · $m^{1/2}$ | ksi · $in^{1/2}$ | Remarks |
| Alloy 163 | Ti 6.5Al 4.15V 0.21O | TB-50 deg C. | 482 deg C./8 hrs | 955 | 138.5 | 1027 | 149.0 | 19.0 | 43.5 | 214.5 | 230.8 | 73.7 | 67.7 | Ti-64, Comparison |
| Alloy 164 | Ti 5.3Al 7.7V 0.5Si 0.20O | | | 1072 | 155.5 | 1162 | 168.5 | 14.1 | 36.5 | 237.2 | 257.0 | 40.1 | 36.8 | Inventive Example |
| Alloy 165 | Ti 5.3Al 7.7V 0.5Si 0.16O | | | 1065 | 154.5 | 1151 | 167.0 | 14.0 | 36.0 | 235.9 | 255.0 | 39.7 | 36.5 | Inventive Example |
| Alloy 166 | Ti 5.3Al 7.7V 0.3Si 0.20O | | | 1055 | 153.0 | 1131 | 164.0 | 16.6 | 46.5 | 233.1 | 249.9 | 67.4 | 61.9 | Inventive Example |
| Alloy 167 | Ti 5.3Al 7.7V 0.3Si 0.16O | | | 993 | 144.0 | 1065 | 154.5 | 16.3 | 43.5 | 219.4 | 235.4 | 71.3 | 65.5 | Inventive Example |
| Alloy 168 | Ti 5.3Al 7.7V 0.1Si 0.20O | | | 979 | 142.0 | 1062 | 154.0 | 18.4 | 44.0 | 216.2 | 234.5 | 70.6 | 64.8 | Comparison |
| Alloy 169 | Ti 5.3Al 7.7V 0.1Si 0.16O | | | 972 | 141.0 | 1055 | 153.0 | 17.3 | 53.0 | 214.6 | 232.9 | 78.4 | 72.0 | Comparison |

TABLE 12

Results of room temperature tensile tests after STA heat treatment

| | | | | 0.2% PS | | UTS | | El | RA | Specific Strength (0.2% PS) | Specific Strength (UTS) | |
|---|---|---|---|---|---|---|---|---|---|---|---|---|
| ID | Alloy | ST | Aging | MPa | ksi | MPa | ksi | % | % | kN · m/kg | kN · m/kg | Remarks |
| Alloy 163 | Ti 6.5Al 4.15V 0.21O | TB-50° C. | 600° C./ 2 hrs | 958 | 139.0 | 1020 | 148.0 | 17.7 | 43.0 | 215.3 | 229.2 | Ti-64, Comparison |
| Alloy 164 | Ti 5.3Al 7.7V 0.5Si 0.20O | | | 1020 | 148.0 | 1107 | 160.5 | 14.5 | 31.0 | 225.7 | 244.8 | Inventive Example |
| Alloy 165 | Ti 5.3Al 7.7V 0.5Si 0.16O | | | 1007 | 146.0 | 1086 | 157.5 | 14.1 | 34.5 | 222.9 | 240.5 | Inventive Example |
| Alloy 166 | Ti 5.3Al 7.7V 0.3Si 0.20O | | | 1007 | 146.0 | 1082 | 157.0 | 16.4 | 42.0 | 222.5 | 239.2 | Inventive Example |
| Alloy 167 | Ti 5.3Al 7.7V 0.3Si 0.16O | | | 1038 | 150.5 | 1114 | 161.5 | 16.0 | 48.0 | 229.3 | 246.1 | Inventive Example |
| Alloy 168 | Ti 5.3Al 7.7V 0.1Si 0.20O | | | 1017 | 147.5 | 1103 | 160.0 | 17.2 | 48.5 | 224.6 | 243.6 | Comparison |
| Alloy 169 | Ti 5.3Al 7.7V 0.1Si 0.16O | | | 948 | 137.5 | 1017 | 147.5 | 18.8 | 51.0 | 209.3 | 224.5 | Comparison |

As shown in the tables and the figure, the new alpha-beta titanium alloys exhibit higher than a target strength and elongation in all conditions demonstrating robustness in heat treatment variations. Fracture toughness $K_{IC}$ is given in the Table 11. There is a trade-off between strength and fracture toughness in general. Within the inventive alloys, the fracture toughness can be controlled by an adjustment of chemical compositions, such as silicon and oxygen contents, depending on fracture toughness requirements.

For titanium alloys used as components of jet engine compressors, maintaining strength during use at moderately elevated temperatures (up to about 300° C./572° F.) is important. Elevated temperature tensile tests were performed on the coupons after aging at 930° F. (499° C.) for 8 hours. The results of the tests are given in Table 13 and FIG. 5B. The results show that all alloys exhibit significantly higher strengths than Ti-64 (Alloy 163). It is also apparent that strength increases with Si content in the Ti-5.3Al-7.7V—Si—O alloy system. Strength can be raised by about 15% from the level of Ti-64 (Alloy 163), showing dotted line in the figure, if the silicon content of Ti-5.3Al-7.7V—Si—O alloy is higher than about 0.15%.

TABLE 13

Results of elevated temperature tensile tests (Test temperature: 300° C./572° F.)

| ID | Alloy | 0.2% PS MPa | 0.2% PS ksi | UTS MPa | UTS ksi | El % | RA % |
|---|---|---|---|---|---|---|---|
| Alloy 163 | Ti 6.5Al 4.15V 0.21O | 562 | 81.5 | 712 | 103.3 | 25 | 62.0 |
| Alloy 164 | Ti 5.3Al 7.7V 0.5Si 0.20O | 761 | 110.4 | 923 | 133.9 | 19 | 51.5 |
| Alloy 165 | Ti 5.3Al 7.7V 0.5Si 0.16O | 736 | 106.7 | 893 | 129.5 | 18 | 50.5 |
| Alloy 166 | Ti 5.3Al 7.7V 0.3Si 0.20O | 703 | 101.9 | 858 | 124.5 | 21 | 61.0 |
| Alloy 167 | Ti 5.3Al 7.7V 0.3Si 0.16O | 654 | 94.8 | 825 | 119.6 | 20 | 57.5 |
| Alloy 168 | Ti 5.3Al 7.7V 0.1Si 0.20O | 649 | 94.1 | 801 | 116.2 | 22 | 61.5 |
| Alloy 169 | Ti 5.3Al 7.7V 0.1Si 0.16O | 641 | 92.9 | 799 | 115.9 | 18 | 61.5 |

EXAMPLE E

A 30 inch diameter ingot weighing 3.35 tons was produced (Heat number FR88735). A chemical composition of the ingot was Ti-5.4Al-7.6V-0.46Si-0.21Fe-0.06C-0.20O in wt. %. The ingot was subjected to breakdown-forge followed by a series of forgings in the alpha-beta temperature range. A 6" (152 mm) diameter billet was used for the evaluation of properties after upset forging. 6" (152 mm) diameter×2" (51 mm) high billet sample was heated at 1670° F. (910° C.), upset forged to 0.83" (21 mm) thick, followed by STA heat treatment 1670° F. (910° C.) for 1 hour then fan air cool, followed by 932° F. (500° C.) for 8 hours, then air cool. Room temperature tensile tests, elevated temperature tensile tests and low cycle fatigue tests were conducted.

TABLE 14

RT tensile test results of Ti-575 alloy pancake as compared with Ti-64 plate

| Alloy | Test Temp. ° C. | Test Temp. ° F. | Direction | 0.2% PS MPa | 0.2% PS ksi | UTS MPa | UTS ksi | Elong$^{n.}$ 565√A (%) | RA (%) | Remarks |
|---|---|---|---|---|---|---|---|---|---|---|
| Ti 6-4 | 20 | 68 | L | 928 | 134.6 | 1021 | 148.1 | 16 | 27.5 | Comparison |
| FR88735 | 20 | 68 | Pancake | 1050 | 152.3 | 1176 | 170.6 | 15 | 42 | Inventive Example |
| FR88735 | 200 | 392 | Pancake | 815 | 118.2 | 958 | 138.9 | 15 | 59 | Inventive Example |
| Ti 6-4 | 300 | 572 | T | 563 | 81.7 | 698 | 101.2 | 17.5 | 48 | Comparison |
| Ti 6-4 | 300 | 572 | L | 589 | 85.4 | 726 | 105.3 | 16 | 48.5 | Comparison |
| FR88735 | 300 | 572 | Pancake | 720 | 104.4 | 897 | 130.1 | 16 | 61 | Inventive Example |
| FR88735 | 400 | 752 | Pancake | 696 | 100.9 | 846 | 122.7 | 14.5 | 64.5 | Inventive Example |
| FR88735 | 500 | 932 | Pancake | 603 | 87.5 | 777 | 112.7 | 23 | 78 | Inventive Example |

Table 14 summarizes the test results and the results are given in FIG. 6A graphically as well. The new alpha-beta Ti alloy (Ti-575, Heat FR88735) shows higher strength than Ti-64 consistently at elevated temperatures.

Low cycle fatigue (LCF) tests were conducted after taking specimens from the upset pancake forged material. The pancakes were STA heat treated with the condition of 1670° F. (910° C.) for 1 hour then fan air cool, followed by 932° F. (500° C.) for 8 hours then air cool. Smooth surface LCF (Kt=1) and Notch LCF test (Kt=2.26) were performed. In addition to standard LCF tests, dwell time LCF was also conducted at selected stress levels to examine dwell sensitivity of the inventive alloy. The results of smooth surface LCF and dwell time LCF tests are displayed in FIG. 6B, and the results of the notch LCF tests are given in FIG. 6C. In each test, results for Ti-64 plate are also given for comparison. The fatigue testing was discontinued at $10^5$ cycles.

The results in FIG. 6B show that the maximum stress of the inventive alloys are 15~20% higher than that of Ti-64 plate for equivalent LCF cycles. It also appears that Ti-575 does not have any dwell sensitivity, judging from the cycles of both the LCF and dwell LCF tests at a given maximum stress. Notch LCF tests shown in FIG. 6C indicate that Ti-575 shows 12~20% higher maximum stress than that of Ti-64 plate for equivalent LCF cycles.

Fatigue crack growth rate tests were performed on the compact tension specimens taken from the same pancake. FIG. 6D shows the results of the tests, where the data are compared with the data for Ti-64. As can be seen in the figure, the fatigue crack growth rate of the inventive alloy (Ti-575) is equivalent to that of Ti-64.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein.

Furthermore, the advantages described above are not necessarily the only advantages of the invention, and it is not necessarily expected that all of the described advantages will be achieved with every embodiment of the invention.

What is claimed is:

1. A method of making an alpha-beta titanium alloy comprising:

forming a melt comprising:

Al at a concentration from about 4.7 wt. % to about 6.0 wt. %;

V at a concentration from about 6.5 wt. % to about 8.0 wt. %;

Si at a concentration of less than 1 wt. %;

Fe at a concentration of up to about 0.3 wt. %;

O at a concentration of less than 1 wt. %; and

Ti and incidental impurities as a balance; and solidifying the melt to form an ingot;

wherein an Al/V ratio in the melt is equal to the concentration of the Al divided by the concentration of the V in weight percent is from about 0.65 to about 0.8.

2. The method of claim 1, wherein the melting comprises one or more of: vacuum arc remelting, electron beam cold hearth melting, and plasma cold hearth melting.

3. The method of claim 1, further comprising:

thermomechanically processing the ingot to form a workpiece; and solution heat treating and aging the workpiece, wherein the solution treated and aged workpiece comprises an elongation of at least 10% at room temperature.

4. The method of claim 3, wherein the thermomechanical processing comprises one or more of: open die forging, closed die forging, rotary forging, hot rolling, and hot extrusion.

5. The method of claim 3, wherein the heat treating comprises beta annealing.

6. The method of claim 5, wherein the heat treating comprises:

solution treating the workpiece at a first temperature from about 150° C. to about 25° C. below beta transus;

cooling the workpiece to ambient temperature; and aging the workpiece at a second temperature lower than the first temperature.

7. The method of claim 6, wherein the second temperature is in the range from about 400° C. to about 625° C.

8. The method of claim 1, wherein the melt further comprises an additional alloying element at a concentration of less than 1.5 wt. %, the additional alloying element being selected from the group consisting of Sn and Zr.

9. The method of claim 1, wherein the melt further comprises Mo at a concentration of less than 0.6 wt. %.

10. The method of claim 1, wherein the melt comprises Si from about 0.15 wt. % to about 0.6 wt. % and O from about 0.15 wt. % to about 0.23 wt. %.

11. The method of claim 1, wherein the melt comprises:

Al at a concentration from about 5.0 to about 5.6 wt. %;

V at a concentration from about 7.2 wt. % to about 8.0 wt. %;

Si at a concentration from about 0.2 wt. % to about 0.5 wt. %;

C at a concentration from about 0.02 wt. % to about 0.08 wt. %; and

O at a concentration from about 0.17 wt. % to about 0.22 wt. %.

12. The method of claim 1, wherein each of the incidental impurities has a concentration of 0.1 wt. % or less in the melt.

13. The method of claim 1, wherein the incidental impurities together have a concentration of 0.5 wt. % or less in the melt.

14. The method of claim 1, wherein precipitates of an alpha phase are dispersed within a beta phase.

15. The method of claim 1, wherein the ingot comprises a yield strength of at least 970 MPa and an elongation of at least 10% at room temperature.

16. The method of claim 1, wherein the ingot has a low cycle fatigue (LCF) maximum stress of at least about 925 MPa over about 65,000 cycles.

17. The method of claim 1, wherein the ingot has a low cycle fatigue (LCF) maximum stress between about 950 MPa over about 68,000 cycles and 1,010 MPa over about 46,000 cycles.

18. The method of claim 1, wherein the ingot has a density less than 4.57 g/cm$^3$.

* * * * *